US010540929B2

(12) United States Patent
Hyun et al.

(10) Patent No.: US 10,540,929 B2
(45) Date of Patent: Jan. 21, 2020

(54) ORGANIC LIGHT EMITTING DISPLAY DEVICE AND DRIVING METHOD THEREOF

(71) Applicant: SAMSUNG DISPLAY CO., LTD., Yongin-si, Gyeonggi-do (KR)

(72) Inventors: Chae Han Hyun, Yongin-si (KR); Seung Kyu Lee, Yongin-si (KR); Jung Hun Yi, Yongin-si (KR); Seon I Jeong, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 75 days.

(21) Appl. No.: 15/804,121

(22) Filed: Nov. 6, 2017

(65) Prior Publication Data

US 2018/0261163 A1 Sep. 13, 2018

(30) Foreign Application Priority Data

Mar. 13, 2017 (KR) ..... 10-2017-0031091

(51) Int. Cl.
*G09G 3/3233* (2016.01)
*G09G 3/3266* (2016.01)

(52) U.S. Cl.
CPC ..... *G09G 3/3266* (2013.01); *G09G 3/3233* (2013.01); *G09G 2310/08* (2013.01); *G09G 2330/028* (2013.01); *G09G 2354/00* (2013.01)

(58) Field of Classification Search
CPC .. G09G 3/3225; G09G 3/3266; G09G 3/3233; G09G 2310/0213; G02B 27/01; G02B 27/017
See application file for complete search history.

(56) References Cited

U.S. PATENT DOCUMENTS 8,803,770 B2 8/2014 Jeong et al.
9,208,727 B2 12/2015 Lee et al.
2008/0150846 A1* 6/2008 Chung ..... G09G 3/3233 345/80
2014/0184665 A1* 7/2014 Yoon ..... G09G 3/3241 345/691
2015/0187270 A1* 7/2015 Lee ..... G09G 3/3233 345/76

(Continued)

FOREIGN PATENT DOCUMENTS

KR 101152466 B1 5/2012
KR 1020140134046 A 11/2014

(Continued)

*Primary Examiner* — Yuzhen Shen
(74) *Attorney, Agent, or Firm* — Cantor Colburn LLP

(57) ABSTRACT

An organic light emitting display device includes: a first pixel region including first pixels coupled to first and second scan lines, and emission control lines; a first scan driver which supplies a first scan signal to each first scan line; a second scan driver which supplies a second scan signal to each second scan line; and an emission driver which supplies a light emission control signal to the emission control lines. The organic light emitting display device is in a second mode when the organic light emitting display device is mounted in a wearable device, and in a first mode otherwise. The second scan driver supplies k second scan signals to each second scan line in the first mode, and supplies j second scan signals to each second scan line in the second mode, where j is greater than k.

17 Claims, 16 Drawing Sheets

(56) References Cited

U.S. PATENT DOCUMENTS

| | | | | |
|---|---|---|---|---|
| 2017/0098413 | A1* | 4/2017 | Lee | G11C 19/28 |
| 2017/0193899 | A1* | 7/2017 | Yoon | G09G 3/3233 |
| 2018/0144688 | A1* | 5/2018 | Lee | G09G 3/3225 |
| 2018/0151125 | A1* | 5/2018 | Lee | G09G 3/3233 |

FOREIGN PATENT DOCUMENTS

| | | | |
|---|---|---|---|
| KR | 1020150064543 | A | 6/2015 |
| KR | 101691492 | B1 | 12/2016 |

* cited by examiner

ORGANIC LIGHT EMITTING DISPLAY DEVICE AND DRIVING METHOD THEREOF

The application claims priority to Korean Patent Application No. 10-2017-0031091, filed on Mar. 13, 2017, and all the benefits accruing therefrom under 35 U.S.C. § 119i, the content of which in its entirety is herein incorporated by reference.

BACKGROUND

1. Field

Embodiments of the disclosure relate to an organic light emitting display device and a driving method thereof, and more particularly, to an organic light emitting display device with improved display quality and a driving method of the organic light emitting display device.

2. Description of the Related Art

Recently, various types of electronic devices directly wearable on a body of a user have been developed. Such devices are generally called a wearable electronic device.

In particular, as an example of the wearable electronic device, a head mounted display device (hereinafter, referred to as "HMD") displays a realistic image and hence provides high-degree immersion. Accordingly, the HMD is used in various usages including movie appreciation.

SUMMARY

Embodiments of the invention is directed to an organic light emitting display with improved display quality and a driving method of the organic light emitting display device.

According to an embodiment of the disclosure, an organic light emitting display device includes: a first pixel region including first pixels which are coupled to first scan lines, second scan lines and emission control lines; a first scan driver which supplies a first scan signal to each of the first scan lines coupled to the first pixels; a second scan driver which supplies a second scan signal to each of the second scan lines coupled to the first pixels; and an emission driver which supplies a light emission control signal to the emission control lines coupled to the first pixels. In such an embodiment, the organic light emitting display device is driven in a second mode when the organic light emitting display device is mounted in a wearable device, and is driven in a first mode otherwise. In such an embodiment, the first pixels are driven based on a data signal when the organic light emitting display device is driven in the first mode and the second mode. In such an embodiment, the second scan driver supplies k second scan signals to each of the second scan lines when the organic light emitting display device is driven in the first mode, and supplies j second scan signals to each of the second scan lines when the organic light emitting display device is driven in the second mode, where k is a natural number, and j is a natural number greater than k.

In an embodiment, the organic light emitting display device may further include a second pixel region including second pixels driven based on the data signal when the organic light emitting display device is driven in the first mode, where the second pixel region is set to be in a non-emission state when the organic light emitting display device is driven in the second mode.

In an embodiment, the organic light emitting display device may further include a third pixel region including third pixels driven corresponding to the data signal when the organic light emitting display device is driven in the first mode, where the third pixel region is set to be in the non-emission state when the organic light emitting display device is driven in the second mode.

In an embodiment, the first pixel region may be located between the second pixel region and the third pixel region.

In an embodiment, the emission driver may supply p light emission control signals to each of the emission control lines when the organic light emitting display device is driven in the first mode, where p is a natural number, and the emission driver may supply l light emission control signals to each of the emission control lines when the organic light emitting display device is driven in the second mode, where l is a natural number greater than p.

In an embodiment, each of pixels located on an i-th pixel row may include: an organic light emitting diode; a pixel circuit which stores a voltage of the data signal when the first scan signal is supplied to an i-th first scan line of the first scan lines, and controls the supply time of a current to the organic light emitting diode, based on a light emission control signal supplied to an i-th emission control line of the emission control lines; and a first transistor coupled between an initialization power source and an anode electrode of the organic light emitting diode. In such an embodiment, the first transistor is turned on when the second scan signal is supplied to an i-th second scan line of the second scan lines, where i is a natural number.

In an embodiment, a voltage of the initialization power source may have a predetermined voltage level such that the organic light emitting diode emits no light when the voltage of the initialization power source is applied thereto.

In an embodiment, when the organic light emitting display device is driven in the first mode, the emission driver may supply a light emission control signal to the i-th emission control line during a partial period in one frame period, the first scan driver may supply the first scan signal to an (i−1)-th first scan line of the first scan lines and the i-th first scan line to overlap with the light emission control signal, and the second scan driver may supply the second scan signal to the i-th second scan line to overlap with the light emission control signal.

In an embodiment, the light emission control signal may be set to be a gate-off voltage, and the first scan signal and the second scan signal may be set to be a gate-on voltage.

In an embodiment, the i-th second scan line may be defined by any one of the first scan lines supplied with the first scan signal to overlap with the light emission control signal supplied to the i-th emission control line.

In an embodiment, the first scan driver and the second scan driver may be disposed in a same scan driver.

In an embodiment, when the organic light emitting display device is driven in the second mode, the emission driver may supply a first light emission control signal to the i-th emission control line, and the emission driver may supply a second light emission control signal to the i-th emission control line after a predetermined period from the first light emission control signal in one frame period.

In an embodiment, the predetermined period may be set as a period which is about 40% or less of the one frame period.

In an embodiment, the first scan driver may supply the first scan signal to the (i−1)-th first scan line and the i-th first scan line to overlap with the first light emission control signal. In such an embodiment, the second scan driver may supply a first second scan signal to the i-th second scan line to overlap with the first light emission control signal, and supply a second second scan signal to the i-th second scan line to overlap with the second light emission control signal.

In an embodiment, the first second scan signal and the second second scan signal may have a same width as each other.

In an embodiment, the second second scan signal may have a width wider than a width of the first second scan signal.

In an embodiment, the pixel circuit may include: a driving transistor which controls an amount of a current supplied from a first power source coupled to a first electrode thereof to the organic light emitting diode coupled to a second electrode thereof, based on a voltage of a first node; a second transistor coupled between a data line and the first electrode of the driving transistor, where the second transistor includes a gate electrode coupled to the i-th first scan line; a third transistor coupled between the second electrode of the driving transistor and the first node, where the third transistor includes a gate electrode coupled to the i-th first scan line; a fourth transistor coupled between the first node and the initialization power source, where the fourth transistor includes a gate electrode coupled to the (i−1)-th first scan line; a fifth transistor coupled between the first power source and the first electrode of the driving transistor, the fifth transistor having a gate electrode coupled to the i-th emission control line; a sixth transistor coupled between the second electrode of the driving transistor and the anode electrode of the organic light emitting diode, where the sixth transistor includes a gate electrode coupled to the i-th emission control line; and a storage capacitor coupled between the first power source and the first node.

According to an embodiment of the disclosure, a method for driving an organic light emitting display device including a pixel which includes a first transistor coupled between an anode electrode of an organic light emitting diode and an initialization power source, where the first transistor is turned on when a scan signal is supplied thereto, the method including: supplying k scan signals when the organic light emitting display device is driven in a first mode, where k is a natural number; and supplying j scan signals when the organic light emitting display device is driven in a second mode, where j is a natural number greater than k. In such an embodiment, the organic light emitting display device is driven in the second mode when the organic light emitting display device is mounted in a wearable device, and is driven in the first mode otherwise.

In an embodiment, a voltage of the initialization power source may have a predetermined voltage such that the organic light emitting diode emits no light when the voltage of the initialization power source is applied thereto.

In an embodiment, when the organic light emitting display device is driven in the second mode, an emission period of the pixel may be set to a period which is about 40% or less of one frame period.

In an embodiment, at least one scan signal may be supplied during a first non-emission period before the emission period in the one frame period, and at least one scan signal may be supplied during a second non-emission period after the emission period in the one frame period.

BRIEF DESCRIPTION OF THE DRAWINGS

The above and other aspects and features of the disclosure will become more apparent by describing in further detail exemplary embodiments thereof with reference to the accompanying drawings, in which.

DETAILED DESCRIPTION

Figure 1A:
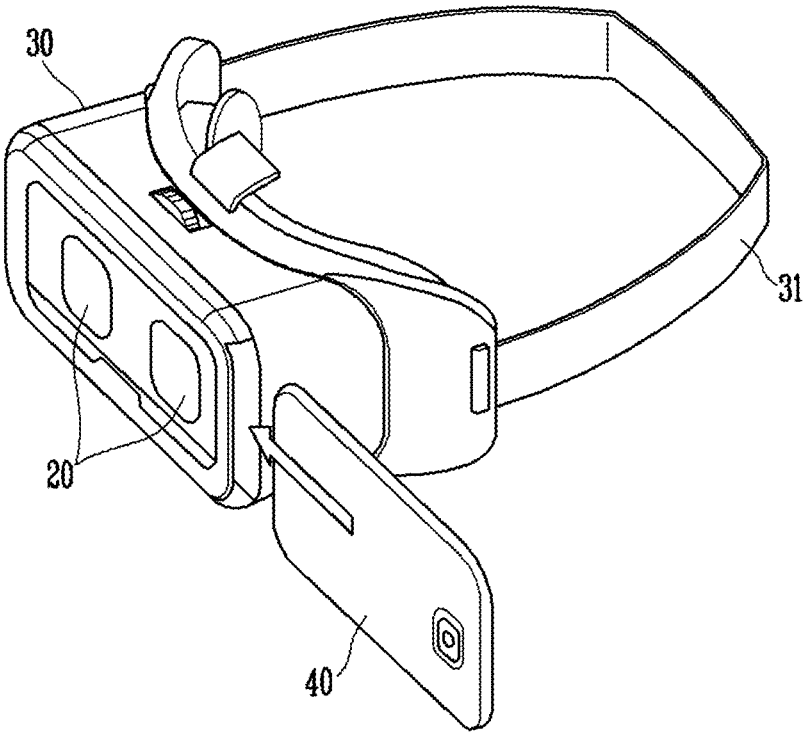
FIGS. 1A and 1B are perspective views schematically illustrating a wearable device according to an embodiment of the disclosure.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. It will be understood that when an element is referred to as being "connected" or "coupled" to another element, it can be directly connected or coupled to the another element or be indirectly connected or coupled to the another element with one or more intervening elements interposed therebetween. In contrast, when an element is referred to as being "directly connected" or "directly coupled" to another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the disclosure will be described in detail with reference to the accompanying drawings.

Figure 1B:
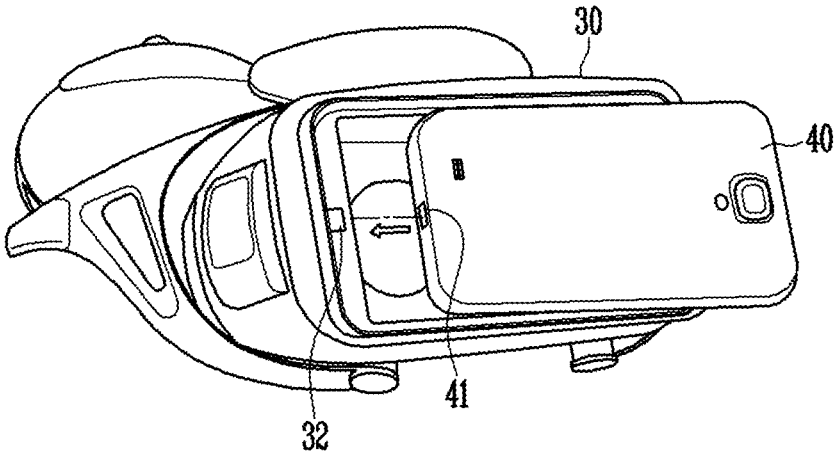

FIGS. 1A and 1B are perspective views schematically illustrating a wearable device according to an embodiment of the disclosure. In FIGS. 1A and 1B, an embodiment where the wearable device is a head mounted display device ("HMD") is illustrated.

Referring to FIGS. 1A and 1B, an embodiment of the wearable device or the HMD includes a body part 30.

In such an embodiment, the HMD further includes a band 31 connected to the body part 30. The band 31 allows a user to wear the body part 30 on a head thereof. The body part 30 has a structure in which a display device 40 is detachably mounted thereto.

The display device 40 may be, for example, a smart phone. However, in the embodiment of the disclosure, the display device 40 is not limited to the smart phone. In one alternative embodiment, for example, the display device 40 may be any one of electronic devices each having a display means, such as a tablet PC, an electronic book reader, a personal digital assistant ("PDA"), a portable multimedia player ("PMP"), and a camera. Hereinafter, for convenience of description, embodiments where the display device 40 is an organic light emitting display device will be described in detail.

When the display device 40 is mounted to the body part 30, a connection part 41 of the display device 40 is electrically coupled to a connection part 32 of the body part 30, and accordingly, communication between the body part 30 and the display device 40 may be performed. In an embodiment, although not shown in the drawings, the HMD may include at least one of a touch panel, a button, and a wheel key to control the display device 40.

When the display device 40 is mounted in the HMD, the display device 40 may be driven in a second mode. When the display device 40 is separated from the HMD, the display device 40 may be driven in a first mode. When the display device 40 is mounted in the HMD, the driving mode of the display device 40 may be automatically changed to the second mode, or be changed to the second mode by a setting of the user.

In an embodiment, when the display device 40 is separated from the HMD, the driving mode of the display device 40 may be automatically changed to the first mode, or be changed to the first mode by a setting of the user.

The HMD includes lenses 20 corresponding to two eyes of the user. The lenses 20 may be set as fisheye lenses, wide-angle lenses, or the like to increase the field of view ("FOV") of the user.

In a state where the display device 40 is fixed to the body part 30, the user views the display device 40 via the lenses 20, such that an effect as if the user views images displayed on a large-sized screen located at a certain distance therefrom is provided.

In such an embodiment, since the user views the display device 40 via the lenses 20, an effective display unit is divided into a region having a high visibility and a region having a low visibility. In an embodiment, based on two eyes of the user, a central region may have a high visibility, and the other region may have a low visibility.

Thus, in an embodiment, when the display device 40 is driven in the second mode an image is displayed in only a partial region of the effective display unit to allow the user to view more vivid images. When the image is displayed in only the partial region of the effective display unit, a driving frequency may be increased, and accordingly, the display device 40 may display vivid images. In such an embodiment, a gate-off voltage is supplied to signal lines (scan lines, emission control lines, etc.) located in the other region except the partial region of the effective display unit, and accordingly, pixels located in the other region are set to be in a non-emission state.

Figure 2:
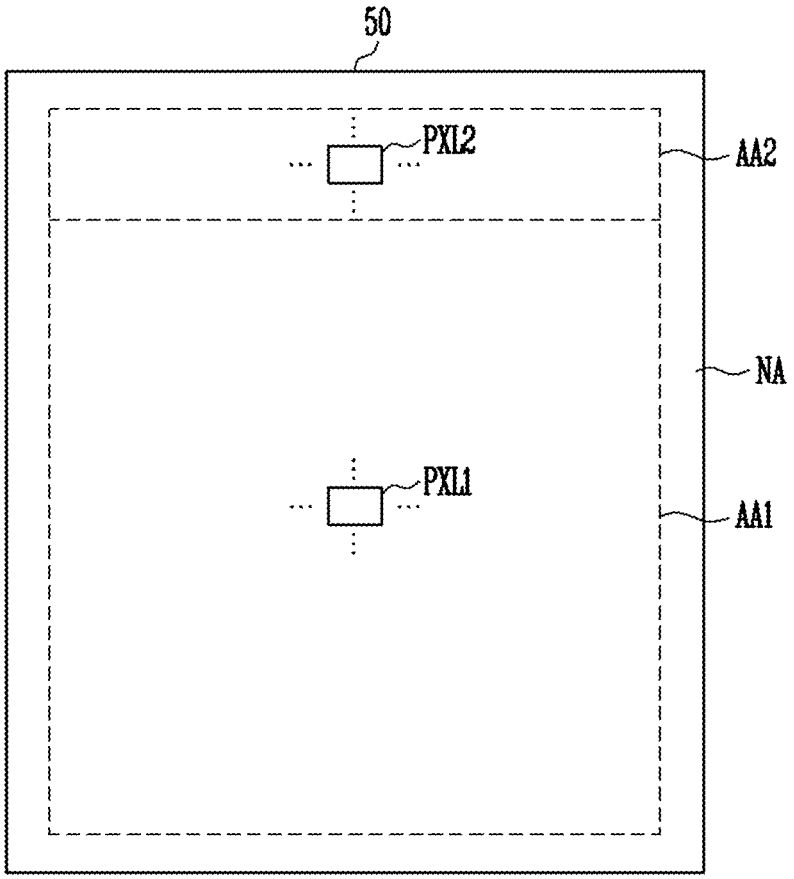
FIG. 2 is a view illustrating a pixel region of an organic light emitting display device according to an embodiment of the disclosure.

FIG. 2 is a view illustrating a pixel region of a display device according to an embodiment of the disclosure. Hereinafter, for convenience of description, an embodiment where the display device is an organic light emitting display device will be described in detail.

Referring to FIG. 2, in such an embodiment, the organic light emitting display device includes pixel regions AA1 and AA2 and a peripheral region NA. In such an embodiment, the pixel regions AA1 and AA2 and the peripheral region NA may be defined on a substrate 50.

A plurality of pixels PXL1 and PXL2 are located in the pixel regions AA1 and AA2, and accordingly, a predetermined image is displayed in the pixel regions AA1 and AA2. Therefore, the pixel regions AA1 and AA2 may define an effective display unit.

Figure 3:
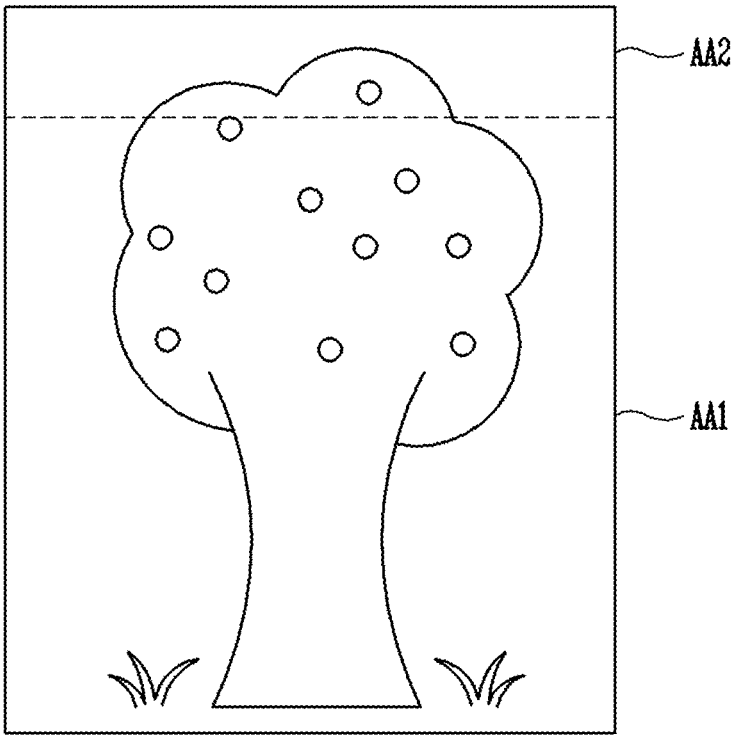
FIGS. 3 and 4 are views illustrating embodiments of images displayed in the pixel region shown in FIG. 2, corresponding to modes.

When the organic light emitting display device is driven in the first mode, as shown in FIG. 3, a predetermined image is displayed in a first pixel region AA1 and a second pixel region AA2.

Figure 4:
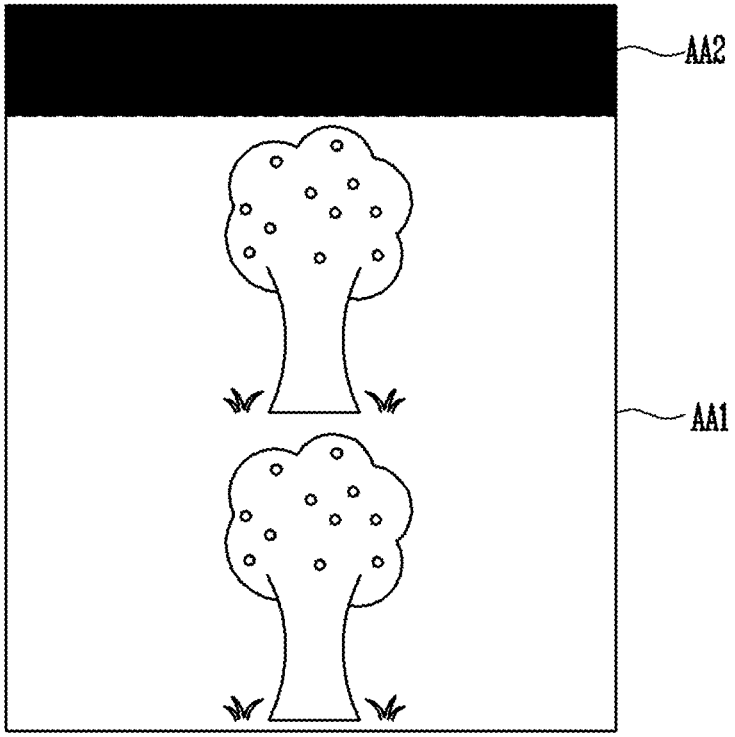

When the organic light emitting display device is driven in the second mode, as shown in FIG. 4, a predetermined image is displayed in the first pixel region AA1. In an embodiment, when the organic light emitting display device is driven in the second mode, the image displayed in the first pixel region AA1 may include two images, which are identical to or different from each other, and are displayed corresponding to two eyes of a user. In such an embodiment, the image displayed in the first pixel region AA1 may be variously set corresponding to characteristics of the HMD, etc.

When the organic light emitting display device is driven in the second mode, second pixels PXL2 included in the second pixel region AA2 are set to be in the non-emission state. In an embodiment, when the organic light emitting display device is driven in the second mode, a black screen image may be displayed in the second pixel region AA2.

In an embodiment, when the organic light emitting display device is driven in the second mode, a partial data signal corresponding to the first pixel region AA1 may be supplied to the second pixel region AA2. Accordingly, in such an embodiment, the second pixels PXL2 included in the second pixel region AA2 may also be set to be in the non-emission state, based on a light emission control signal. In an embodiment, when the organic light emitting display device is driven in the second mode, the second pixels PXL2 included in the second pixel region AA2 may display a predetermined image by the partial data signal corresponding to the first pixel region AA1. That is, in an embodiment of the disclosure, the second pixel region AA2 may be driven in various forms or manner during a period in which the organic light emitting display device is driven in the second mode.

In an embodiment, as shown in FIG. 2, a width of the first pixel region AA1 may be equal to that of the second pixel region AA2, but the disclosure is not limited thereto. In one alternative embodiment, for example, the second pixel region AA2 may have a shape of which width becomes narrower as the second pixel region AA2 becomes more distant from the first pixel region AA1.

In an embodiment, the second pixel region AA2 may have a width narrower than that of the first pixel region AA1. In such an embodiment, a number of second pixels PXL2 arranged along a horizontal line of the second pixel region AA2 may be smaller than that of first pixels PXL1 arranged along a horizontal line of the first pixel region AA1.

In an embodiment of the disclosure, the substrate 50 may have one of various shapes such that the pixel regions AA1 and AA2 may be variously modified based on the shape of the substrate 50. The substrate 50 may include or be made of an insulative material such as glass or resin. In an embodiment, the substrate 50 may include or be made of a material having flexibility to be bendable or foldable. The substrate 50 may have a single-layer structure or a multi-layer structure.

In an embodiment, components (e.g., drivers and lines) for driving the pixels PXL1 and PXL2 are disposed in the peripheral region NA. The pixels PXL1 and PXL2 may not be disposed in the peripheral region NA, and accordingly, the peripheral region NA may define a non-display region. The peripheral region NA is defined at the periphery of the pixel regions AA1 and AA2, and may have a shape surrounding at least a part of the pixel regions AA1 and AA2.

The pixel regions AA1 and AA2 include the first pixel region AA1 and the second pixel region AA2.

The first pixel region AA1 may have a size greater than a size of the second pixel region AA2. In one embodiment, for example, a length of the first pixel region AA1 in a vertical direction is greater than a length of the second pixel region AA1 in the vertical direction, as shown in FIG. 2. The first pixels PXL1 are disposed in the first pixel region AA1. Each of the first pixels PXL1 generate light with a predetermined luminance corresponding to a data signal applied thereto.

The second pixel region AA2 is located at a side of the first pixel region AA1, and may have a smaller area than the first pixel region AA1. The second pixels PXL2 are disposed in the second pixel region AA2. Each of the second pixels PXL2 generate light with a predetermined luminance corresponding to a data signal applied thereto.

Each of the first pixels PXL1 and the second pixels PXL2 includes a driving transistor (not shown) and an organic light emitting diode (not shown). The driving transistor controls an amount of a current supplied to the organic light emitting diode, based on a data signal applied thereto. A gate electrode of the driving transistor is initialized to a voltage of an initialization power source before the driving transistor is supplied with the data signal. In addition, an anode electrode of the organic light emitting diode is initialized to a voltage of the initialization power source before the organic light emitting diode emits light. In an embodiment, the initialization power source is set to a voltage lower than the data signal. The voltage of the initialization power source is set in a way such that light is not emitted from the organic light emitting diode when the voltage of the initialization power source is supplied to the anode electrode of the organic light emitting diode.

Figure 5:
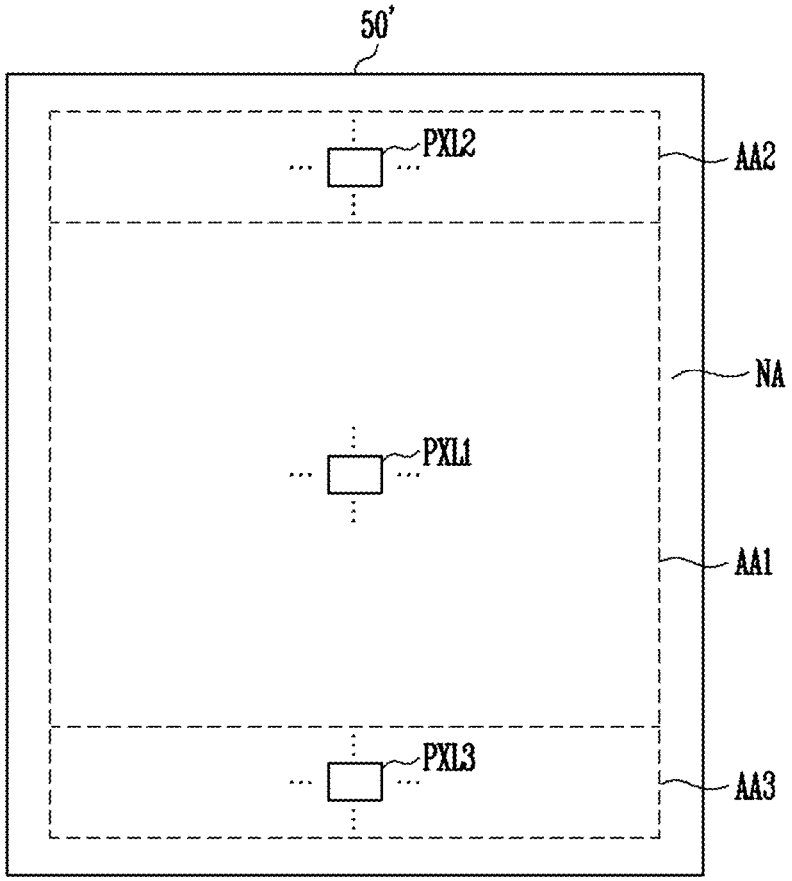
FIG. 5 is a view illustrating a pixel region of an organic light emitting display device according to an alternative embodiment of the disclosure.

FIG. 5 is a view illustrating a pixel region of an organic light emitting display device according to an alternative embodiment of the disclosure. The same or like elements shown in FIG. 5 have been labeled with the same or like reference characters as used above to describe the embodiments of the organic light emitting display device shown in FIG. 2, and any repetitive detailed description thereof will hereinafter be omitted or simplified.

Referring to FIG. 5, an embodiment of the organic light emitting display device includes pixel regions AA1, AA2 and AA3, and a peripheral region NA. In such an embodiment, the pixel regions AA1, AA2 and AA3 and the peripheral region NA may be defined on a substrate 50'.

A plurality of pixels PXL1, PXL2, and PXL3 are disposed in the pixel regions AA1, AA2 and AA3, and accordingly, a predetermined image is displayed in the pixel regions AA1, AA2 and AA3. Therefore, the pixel regions AA1, AA2 and AA3 may define an effective display unit.

Figure 6:
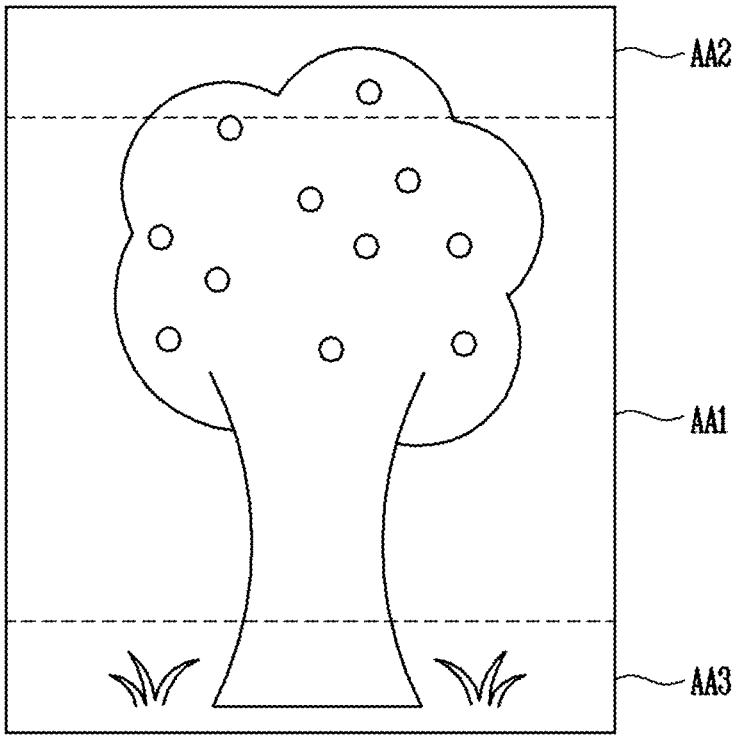
FIGS. 6 and 7 are views illustrating embodiments of images displayed in the pixel region shown in FIG. 5, corresponding to modes.

In an embodiment, when the organic light emitting display device is driven in the first mode, as shown in FIG. 6, a predetermined image is displayed in a first pixel region AA1, a second pixel region AA2 and a third pixel region AA3.

Figure 7:
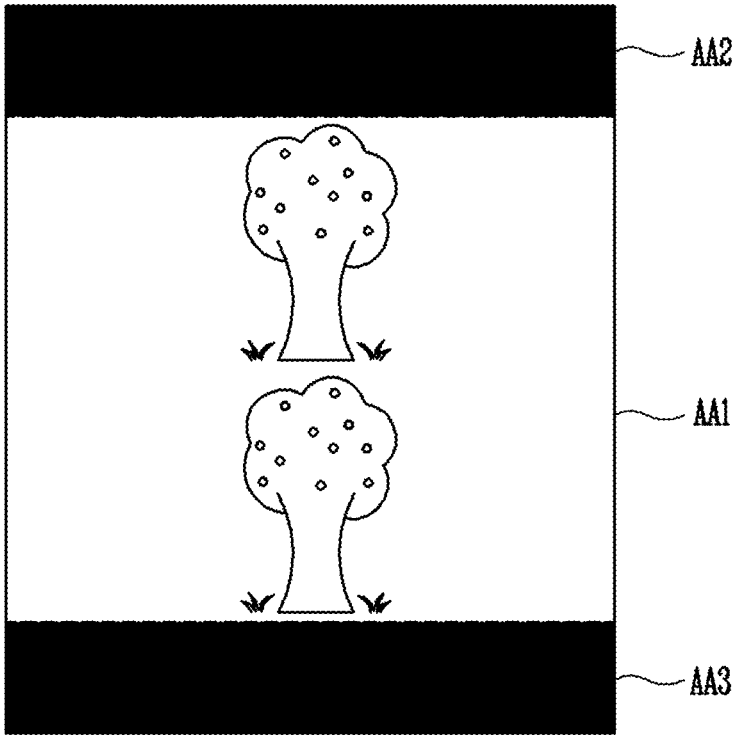

In such an embodiment, when the organic light emitting display device is driven in the second mode, as shown in FIG. 7, a predetermined image is displayed in the first pixel region AA1. In such an embodiment, when the organic light emitting display device is driven in the second mode, second pixels PXL2 included in the second pixel region AA2 and third pixels PXL3 included in the third pixel region AA3 are set to be in the non-emission state. In an embodiment, when the organic light emitting display device is driven in the second mode, a black screen image may be displayed in the second pixel region AA2 and the third pixel region AA3.

In an embodiment, when the organic light emitting display device is driven in the second mode, a partial data signal corresponding to the first pixel region AA1 may be supplied to the second pixel region AA2 and the third pixel region AA3. Accordingly, in such an embodiment, the second pixels PXL2 included in the second pixel region AA2 and the third pixels PXL3 included in the third pixel region AA3 may be set to be in the non-emission state, based on a light emission control signal. In an embodiment, when the organic light emitting display device is driven in the second mode, the second pixels PXL2 included in the second pixel region AA2 and the third pixels PXL3 included in the third pixel region AA3 may display a predetermined image by the partial data signal corresponding to the first pixel region AA1. That is, in an embodiment of the disclosure, the second pixel region AA2 and the third pixel region AA3 may be driven in various forms or manner during a period in which the organic light emitting display device is driven in the second mode.

Components (e.g., drivers and lines) for driving the pixels PXL1, PXL2, and PXL3 may be disposed in the peripheral region NA.

The pixel regions AA1, AA2 and AA3 includes the first pixel region AA1, the second pixel region AA2 and the third pixel region AA3.

The second pixel region AA2 may be located at one side of the first pixel region AA1, and the third pixel region AA3 may be located at another side of the first pixel region AA1. In one embodiment, for example, the second pixel region AA2 and the third pixel region AA3 may be located at opposing sides (e.g., left and right sides, or upper and lower sides) of the first pixel region AA1, respectively. In such an embodiment, the first pixel region AA1 may be located between the second pixel region AA2 and the third pixel region AA3.

The third pixel region AA3 may have a smaller area than the first pixel region AA1. The third pixels PXL3 are disposed in the third pixel region AA3. Each of the third pixels PXL3 generate light with a predetermined luminance corresponding to a data signal applied thereto.

Each of the first pixels PXL1, the second pixels PXL2 and the third pixels PXL3 includes a driving transistor and an organic light emitting diode. The driving transistor controls the amount of the current supplied to the organic light emitting diode, based on a data signal applied thereto. A gate electrode of the driving transistor is initialized to a voltage of an initialization power source before the driving transistor is supplied with the data signal. In addition, an anode electrode of the organic light emitting diode is initialized to the voltage of the initialization power source before the organic light emitting diode emits light.

Figure 8:
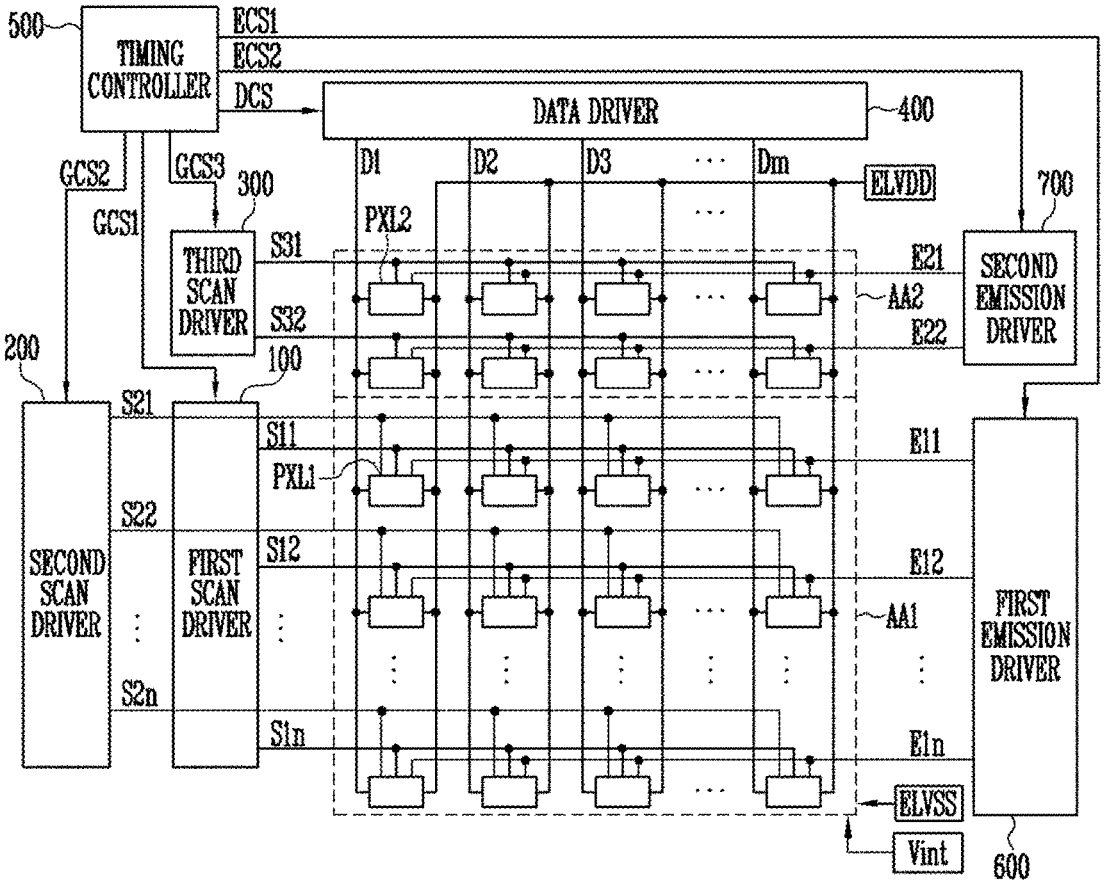
FIG. 8 is a block diagram illustrating an embodiment of the organic light emitting display device corresponding to FIG. 2.

FIG. 8 is a block diagram illustrating an embodiment of the organic light emitting display device corresponding to FIG. 2.

Referring to FIG. 8, an embodiment of the organic light emitting display device includes a first scan driver 100, a second scan driver 200, a third scan driver 300, a data driver 400, a timing controller 500, a first emission driver 600, and a second emission driver 700.

A pixel region is divided into a first pixel region AA1 and a second pixel region AA2. The first pixel region AA1 includes first pixels PXL1, and the second pixel region AA2 includes second pixels PXL2.

The second pixels PXL2 are arranged to be coupled to third scan lines S31 and S32, second emission control lines E21 and E22, and data lines D1 to Dm. The second pixels PXL2 are selected or selectively activated when a third scan signal is supplied to the third scan lines S31 and S32 to be supplied with a data signal supplied from the data lines D1 to Dm. An organic light emitting diode included in each of the second pixels PXL2 is initialized to a voltage of an initialization power source Vint when the third scan signal is supplied.

The second pixels PXL2 supplied with the data signal generate light with a predetermined luminance corresponding to the data signal. In such an embodiment, the emission time (or the emission timing and duration) of the second pixels PXL2 is controlled by a second light emission control signal supplied from the second emission control lines E21 and E22.

The first pixels PXL1 are arranged to be coupled to first scan lines S11 to S1*n*, second scan lines S21 to S2*n*, first emission control lines E11 to E1*n*, and the data lines D1 to Dm. The first pixels PXL1 are selected or selectively activated when a first scan signal is supplied to the first scan lines S11 to S1*n* to be supplied with a data signal from the data lines D1 to Dm. An organic light emitting diode included in each of the first pixels PXL1 is initialized to the voltage of the initialization power source Vint when a second scan signal is supplied.

The first pixels PXL1 supplied with the data signal generate light with a predetermined luminance corresponding to the data signal. In such an embodiment, the emission time of the first pixels PXL1 is controlled by a first light emission control signal supplied from the first emission control lines E11 to E1*n*.

For convenience of illustration, it is illustrated that two third scan lines S31 and S32 and two second emission control lines E21 and E22 are disposed in the second pixel region AA2 in FIG. 8, but the disclosure is not limited thereto. In an embodiment, two or more third scan lines S31 and S32 and two or more second emission control lines E21 and E22 may be disposed in the second pixel region AA2. In an embodiment, one or more dummy scan lines (not shown) and one or more dummy emission control lines (not shown) may be disposed in the pixel regions AA1 and AA2, corresponding to circuit structures of the pixels PXL1 and PXL2.

The third scan driver 300 supplies the third scan signal to the third scan lines S31 and S32, based on a third gate control signal GCS3 from the timing controller 500. In an embodiment, the third scan driver 300 may sequentially supply the third scan signal to the third scan lines S31 and S32. When the third scan signal is sequentially supplied to the third scan lines S31 and S32, the second pixels PXL2 are sequentially selected or turned on in units of horizontal lines, that is, on a pixel row-by-pixel row basis. In such an embodiment, the third scan signal is set to be a gate-on voltage during a predetermined duration such that transistors included in the second pixels PXL2 may be turned on in response to the third scan signal.

In an embodiment, the third scan driver 300 supplies the third scan signal to the third scan lines S31 and S32 when the organic light emitting display device is driven in the first mode, and does not supply the third scan signal to the third scan lines S31 and S32 when the organic light emitting display device is driven in the second mode. Therefore, when the organic light emitting display device is driven in the second mode, the third scan lines S31 and S32 apply a gate-off voltage to the second pixels PXL2 connected thereto.

The first scan driver 100 supplies the first scan signal to the first scan lines S11 to S1*n*, based on a first gate control signal GCS1 from the timing controller 500. In an embodiment, the first scan driver 100 may sequentially supply the first scan signal to the first scan lines S11 to S1*n*. When the first scan signal is sequentially supplied to the first scan lines S11 to S1*n*, the first pixels PXL1 are sequentially selected or turned on in units of horizontal lines. In such an embodiment, the first scan signal is set to be the gate-on voltage during a predetermined duration such that transistors included in the first pixels PXL1 may be turned on in response to the first scan signal.

In an embodiment, when the organic light emitting display device is driven in the first mode and the second mode, the first scan driver 100 supplies the first scan signal to the first scan lines S11 to S1*n*. Thus, the first pixels PXL1 displays a predetermined image corresponding to the data signal, regardless of the mode (i.e., the first mode or the second mode) of the organic light emitting display device.

The second scan driver 200 supplies the second scan signal to the second scan lines S21 to S2*n*, based on a second gate control signal GCS2 from the timing controller 500. In an embodiment, the second scan driver 200 may sequentially supply the second scan signal to the second scan lines S21 to S2*n*. When the second scan signal is sequentially supplied to the second scan lines S21 to S2*n*, the voltage of the initialization power source Vint is supplied to an anode electrode of the organic light emitting diode included in each of the first pixels PXL1 in units of horizontal lines.

The second scan driver 200 supplies k second scan signals (k is a natural number) to each of the second scan lines S21 to S2*n* every predetermined period (e.g., during each frame period) when the organic light emitting display device is driven in the first mode, and the second scan driver 200 supplies j second scan signals (j is a natural number greater than k) to each of the second scan lines S21 to S2*n* every predetermined period when the organic light emitting display device is driven in the second mode. This will be described in detail later.

The second emission driver 700 is supplied with a second emission control signal ECS2 from the timing controller 500. The second emission driver 700 supplied with the second emission control signal ECS2 supplies the second light emission control signal to the second emission control lines E21 and E22. In an embodiment, the second emission driver 700 may sequentially supply the second light emission control signal to the second emission control lines E21 and E22. The second light emission control signal controls the emission time of the second pixel PXL2. In such an embodiment, the second light emission signal is set to be the gate-off voltage during a predetermined time such that the transistor included in the second pixel PXL2 is turned off during the predetermined time.

In an embodiment, when the organic light emitting display device is driven in the first mode, the second emission driver 700 sequentially supplies the second light emission control signal to the second emission control lines E21 and E22. In such an embodiment, when the organic light emitting display device is driven in the second mode, the second emission driver 700 supplies the second light emission control signal to the second emission control lines E21 and E22 during one frame period. In such an embodiment, when the organic light emitting display device is driven in the second mode, the second pixels PXL2 are set to be in the non-emission state.

The first emission driver 600 is supplied with a first emission control signal ECS1 from the timing controller 500. The first emission driver 600 supplied with the first emission control signal ECS1 supplies the first light emission control signal to the first emission control lines E11 to E1*n*. In an embodiment, the first emission driver 600 may sequentially supply the first light emission control signal to the first emission control lines E11 to E1*n*. The first light emission control signal controls the emission time of the first pixel PXL1. In such an embodiment, the first light emission control signal is set to be the gate-off voltage during a predetermined time such that the transistor included in the first pixel PXL1 is turned off during the predetermined time.

In an embodiment, the first emission driver 600 supplies p first light emission control signals (p is a natural number) to each of the first emission control lines E11 to En1 every predetermined period (e.g., during each frame period) when the organic light emitting display device is driven in the first mode, and supplies l first light emission control signals (l is a natural number greater than p) to each of the first emission control lines E11 to E1*n* every predetermined period (e.g., during each frame period) when the organic light emitting display device is driven in the second mode. This will be described in detail later.

The data driver 400 is supplied with a data control signal DCS from the timing controller 500. The data driver 400 supplied with the data control signal DCS supplies a data signal to the data lines D1 to Dm to be synchronized with second scan signal and first scan signal.

The timing controller 500 generates the first gate control signal GCS1, the second gate control signal GCS2, the third gate control signal GCS3, the first emission control signal ECS1, the second emission control signal ECS2 and the data control signal DCS, based on timing signals supplied from the outside.

In an embodiment, the first gate control signal GCS1 generated from the timing controller 500 is supplied to the first scan driver 100, the second gate control signal GCS2 generated from the timing controller 500 is supplied to the second scan driver 200, and the third gate control signal GCS3 generated from the timing controller 500 is supplied to the third scan driver 300. In such an embodiment, the first emission control signal ECS1 generated from the timing controller 500 is supplied to the first emission driver 600, and the second emission control signal ECS2 generated from the timing controller 500 is supplied to the second emission driver 700. In such an embodiment, the data control signal DCS generated from the timing controller 500 is supplied to the data driver 400.

A start signal and clock signals are included in each of the first gate control signal GCS1, the second gate control signal GCS2 and the third gate control signal GCS3. The start signal controls a supply timing of the first scan signal, the second scan signal, or the third scan signal. The clock signals are used to shift the start signal.

An emission start signal and clock signals are included in each of the first emission control signal ECS1 and the second emission control signal ECS2. The emission start signal controls a supply timing of the first light emission control signal or the second light emission control signal. The clock signals are used to shift the emission start signal.

The data control signal DCS includes a source start signal, a source output enable signal, a source sampling clock, and the like. The source start signal controls a data sampling start time of the data driver 400. The source sampling clock controls a sampling operation of the data driver 400, based on a rising or falling edge. The source output enable signal controls an output timing of the data driver 400.

Figure 9:
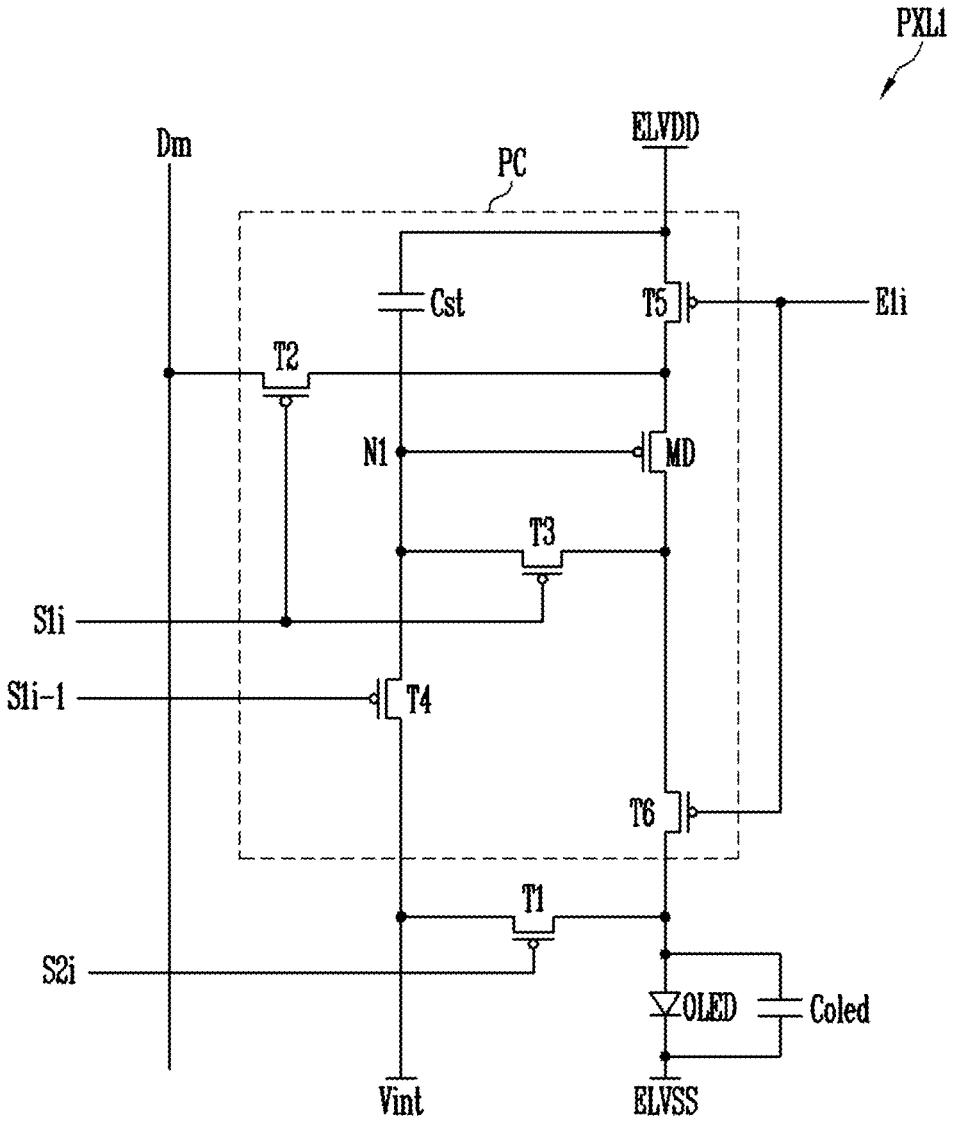
FIG. 9 is a view illustrating an embodiment of a first pixel shown in FIG. 8.

FIG. 9 is a view illustrating an embodiment of the first pixel shown in FIG. 8. For convenience of description, a first pixel PXL1 coupled to an m-th data line Dm (m is a natural number) and an i-th first scan line S1*i* is illustrated in FIG. 9.

Referring to FIG. 9, in an embodiment, the first pixel PXL1 includes an organic light emitting diode OLED, a pixel circuit PC for controlling the amount of the current supplied to the organic light emitting diode OLED, and a first transistor T1.

An anode electrode of the organic light emitting diode OLED is coupled to the pixel circuit PC, and a cathode electrode of the organic light emitting diode OLED is coupled to a second power source ELVSS. The organic light emitting diode OLED generates light with a predetermined luminance corresponding to the amount of the current supplied from the pixel circuit PC. A first power source ELVDD may be set to have a voltage higher than that of the second power source ELVSS such that current is allowed to flow through the organic light emitting diode OLED.

The first transistor T1 is coupled between the initialization power source Vint and the anode electrode of the organic light emitting diode OLED. In such an embodiment, a gate electrode of the first transistor T1 is coupled to an i-th second scan line S2*i*. The first transistor T1 is turned on when the second scan signal is supplied to the i-th second scan line S2*i* to supply the voltage of the initialization power source Vint to the anode electrode of the organic light emitting diode OLED.

When the voltage of the initialization power source Vint is supplied to the anode electrode of the organic light emitting diode OLED, a parasitic capacitor (hereinafter, referred to as an "organic capacitor" Coled) of the organic light emitting diode OLED is discharged. When the organic capacitor Coled is discharged, the black expression ability of the organic light emitting diode is enhanced.

In such an embodiment, the organic capacitor Coled charges a predetermined voltage corresponding to a current supplied from the pixel circuit PC during a previous frame period. When the organic capacitor Coled is charged, light may be easily emitted from the organic light emitting diode OLED by even a low current.

In such an embodiment, a black data signal may be supplied to the pixel circuit PC in a current frame period. When the black data signal is supplied, the pixel circuit PC ideally supplies no current to the organic light emitting diode OLED. However, the pixel circuit PC including transistors may supply a leakage current to the organic light emitting diode OLED even when the black data signal is supplied. When a leakage current is supplied to the organic light emitting diode OLED, if the organic capacitor Coled is in a charged state, the organic light emitting diode OLED may minutely emit light, and accordingly, the black expression ability of the organic light emitting diode OLED is degraded.

In an embodiment of the disclosure, when the organic capacitor Coled is discharged by the voltage of the initialization power source Vint, the organic light emitting diode OLED is set to be in the non-emission state even when a leakage current is supplied. That is, in such an embodiment of the disclosure, the initialization power source Vint is supplied to the anode electrode of the organic light emitting diode OLED, such that the black expression ability of the organic light emitting diode OLED may be enhanced.

The pixel circuit PC further includes a driving transistor MD, second to sixth transistors T2 to T6, and a storage capacitor Cst.

In an embodiment, as shown in FIG. 9, a first electrode of the driving transistor MD is coupled to the first power source ELVDD via the fifth transistor T5, and a second electrode of the driving transistor MD is coupled to the anode electrode of the organic light emitting diode OLED via the sixth transistor T6. In such an embodiment, a gate electrode of the driving transistor MD is coupled to a first node N1. The driving transistor MD controls the amount of the current flowing from the first power source ELVDD to the second power source ELVSS via the organic light emitting diode OLED, based on a voltage of the first node N1.

The second transistor T2 is coupled between the data line Dm and the first electrode of the driving transistor MD. In an embodiment, a gate electrode of the second transistor T2 is coupled to the i-th first scan line S1*i*. The second transistor T2 is turned on when the first scan signal is supplied to the i-th first scan line S1*i* to allow the data line Dm and the first electrode of the driving transistor MD to be electrically coupled to each other.

The third transistor T3 is coupled between the second electrode of the driving transistor MD and the first node N1. In an embodiment, a gate electrode of the third transistor T3 is coupled to the i-th first scan line S1*i*. The third transistor T3 is turned on when the first scan signal is supplied to the i-th first scan line to allow the second electrode of the driving transistor MD and the first node N1 to be electrically coupled to each other. Therefore, when the third transistor T3 is turned on, the driving transistor MD is diode-coupled.

The fourth transistor T4 is coupled between the first node N1 and the initialization power source Vint. In an embodiment, a gate electrode of the fourth transistor T4 is coupled to an (i−1)-th first scan line S1*i*−1. The fourth transistor T4 is turned on when the first scan signal is supplied to the (i−1)-th first scan line S1*i*−1 to supply the voltage of the initialization power source Vint to the first node N1.

The fifth transistor T5 is coupled between the first power source ELVDD and the first electrode of the driving transistor MD. In an embodiment, a gate electrode of the fifth transistor T5 is coupled to an i-th first emission control line E1*i*. The fifth transistor T5 is turned off when a first light emission control signal is supplied to the i-th first emission control line E1*i*, and is turned on otherwise.

The sixth transistor T6 is coupled between the second electrode of the driving transistor MD and the anode electrode of the organic light emitting diode OLED. In an embodiment, a gate electrode of the sixth transistor T6 is coupled to the i-th first emission control line E1*i*. The sixth transistor T6 is turned off when the first light emission control signal is supplied to the i-th first emission control line E1*i*, and is turned on otherwise.

The storage capacitor Cst is coupled between the first power source ELVDD and the first node N1. The storage capacitor Cst stores a voltage corresponding to the data signal and a threshold voltage of the driving transistor MD.

In an embodiment, other pixels, e.g., the second pixel PXL2, has the same circuit structure as the first pixel PXL1 shown in FIG. 9, and accordingly, any repetitive detailed description thereof will be omitted. In an embodiment, a first transistor included in the second pixel PXL2 is coupled to a third scan line. In an embodiment, a first transistor T1 included in a second pixel PXL2 located on a k-th horizontal line (e.g., a k-th pixel row) may be supplied with a third scan signal that overlaps with a second light emission control signal supplied to a k-th second emission control line E2*k*. In one embodiment, for example, a gate electrode of the first transistor T1 included in the second pixel PXL2 located on the k-th horizontal line may be coupled to a (k−1)-th third scan line S3*k*−1, a k-th third scan line S3*k*, or a (k+1)-th third scan line S3*k*+1.

Figure 10:
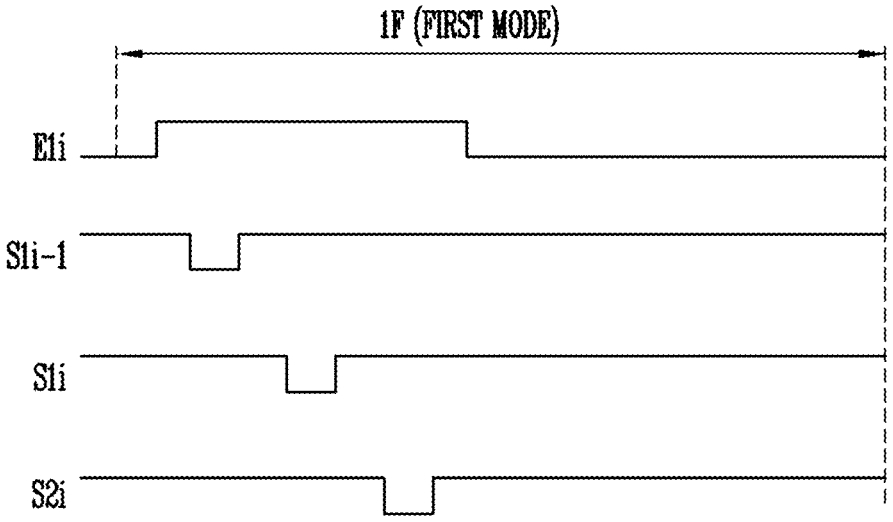
FIG. 10 is a signal timing diagram illustrating an embodiment of a driving method when the first pixel shown in FIG. 9 is driven in a first mode.

FIG. 10 is a signal timing diagram illustrating an embodiment of a driving method when the first pixel shown in FIG. 9 is driven in the first mode.

Referring to FIG. 10, in such an embodiment, the first light emission control signal is supplied to the i-th first emission control line E1*i*. When the first light emission control signal is supplied to the i-th first emission control line E1*i*, the fifth transistor T5 and the sixth transistor T6 are turned off.

When the fifth transistor T5 is turned off, the first power source ELVDD and the first electrode of the driving transistor MD are electrically disconnected from each other. When the sixth transistor T6 is turned off, the second electrode of the driving transistor MD and the anode electrode of the organic light emitting diode OLED are electrically disconnected from each other. Therefore, the first pixel PXL1 is set to be in the non-emission state during a period in which the first light emission control signal is supplied to the i-th first emission control line E1*i*.

After the first light emission control signal is supplied to the i-th first emission control line E1*i*, the first scan signal is supplied to the (i−1)-th first scan line S1*i*−1. When the first scan signal is supplied to the (i−1)-th first scan line S1*i*−1, the fourth transistor T4 is turned on. When the fourth transistor T4 is turned on, the voltage of the initialization power source Vint is supplied to the first node N1.

After the first scan signal is supplied to the (i−1)-th first scan line S1*i*−1, the first scan signal is supplied to the i-th first scan line S1*i*. When first scan signal is supplied to the i-th first scan line S1*i*, the second transistor T2 and the third transistor T3 are turned on.

When the third transistor T3 is turned on, the second electrode of the driving transistor MD and the first node N1 are electrically coupled to each other. That is, when the third transistor T3 is turned on, the driving transistor MD is diode-coupled.

When the second transistor T2 is turned on, the data signal from the data line Dm is supplied to the first electrode of the driving transistor MD. Accordingly, since the first node N1 is set to the voltage of the initialization power source Vint, which is lower than the data signal, the driving transistor MD is turned on.

When the driving transistor MD is turned on, a voltage obtained by subtracting an absolute threshold voltage of the driving transistor MD from a voltage of the data signal is supplied to the first node N1. Accordingly, the storage capacitor Cst stores a voltage corresponding to the voltage of the first node N1.

After the voltage corresponding to the threshold voltage of the driving transistor MD and the data signal is stored, the second scan signal is supplied to the i-th second scan line S2*i*. When the second scan signal is supplied to the i-th second scan line S2*i*, the first transistor T1 is turned on.

When the first transistor T1 is turned on, the voltage of the initialization power source Vint is supplied to the anode electrode of the organic light emitting diode OLED. Then, the organic capacitor Coled of the organic light emitting diode OLED is discharged.

After the organic capacitor Coled of the organic light emitting diode OLED is discharged, the supply of the first light emission control signal to the i-th first emission control line E1*i* is stopped. When the supply of the first light emission control signal to the i-th first emission control line E1*i* is stopped, the fifth transistor T5 and the sixth transistor T6 are turned on. When the fifth transistor T5 is turned on, the first power source ELVDD and the first electrode of the driving transistor MD are electrically coupled to each other. When the sixth transistor T6 is turned on, the second electrode of the driving transistor MD and the anode electrode of the organic light emitting diode OLED are electrically coupled to each other. Accordingly, the driving transistor MD controls the amount of the current flowing from the first power source ELVDD to the second power source ELVSS via the organic light emitting diode OLED, based on the voltage of the first node N1. Then, the organic light emitting diode OLED generates light with a predetermined luminance corresponding to the amount of the current supplied from the driving transistor MD.

In such an embodiment, when the organic light emitting display device is driven in the first mode, the second pixel PXL2 is driven using the same method as the above-described first pixel PXL1. In such an embodiment, the gate electrode of the first transistor T1 included in the second pixel PXL2 located on the k-th horizontal line may be coupled to the (k+1)-th third scan line S3*k*+1. In this case, the second pixel PXL2 is driven using the same method as the above-described first pixel PXL1.

In an embodiment, as shown in FIG. 10, the second scan signal supplied to the i-th second scan line S2*i* is supplied after the first scan signal is supplied to the i-th first scan line S1*i*, but the embodiment of the disclosure is not limited thereto. In an alternative embodiment, the second scan signal supplied to the i-th second scan line S2*i* may be supplied at various times to overlap with the first light emission control signal supplied to the i-th first emission control line E1*i*.

Figure 11:
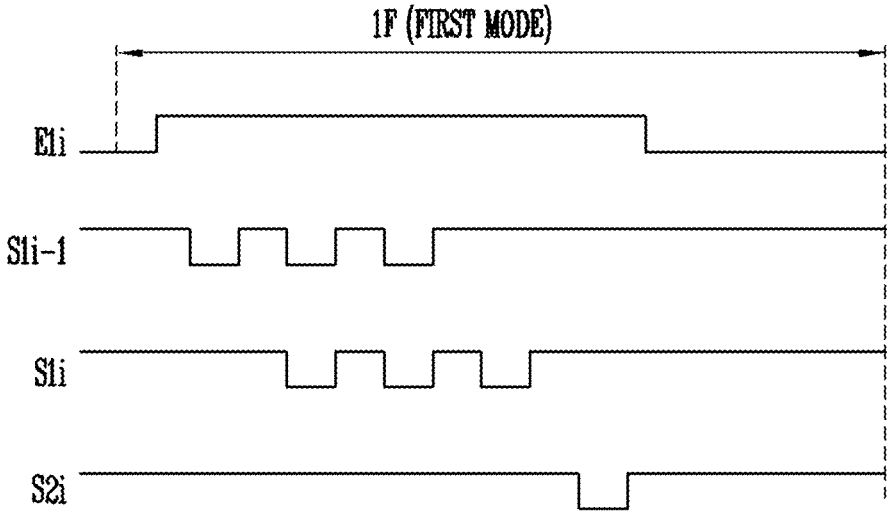
FIG. 11 is a signal timing diagram illustrating an alternative embodiment of the driving method when the first pixel shown in FIG. 9 is driven in the first mode.

In an embodiment, as shown in FIG. 10, one first scan signal is supplied to the first scan lines S1*i*−1 and S1*i*, but the embodiment of the disclosure is not limited thereto. In an alternative embodiment, as shown in FIG. 11, a plurality of first scan signals may be supplied to each of the first scan lines S1*i*−1 and S1*i*. In such an embodiment, when the plurality of first scan signals are supplied to each of the first scan lines S1*i*−1 and S1*i*, a characteristic of the driving transistor MD is initialized to a specific state, and accordingly, the display quality of the organic light emitting display device may be improved.

In an embodiment, when the organic light emitting display device is driven in the second mode, the second pixels PXL2 are set to be in the non-emission state. In an embodiment, when the organic light emitting display device is driven in the second mode, the second emission driver 700 supplies the second light emission control signal to the second emission control lines E21 and E22 during one frame period, and accordingly the second pixel PXL2 may be set to be in the non-emission state.

Figure 12:
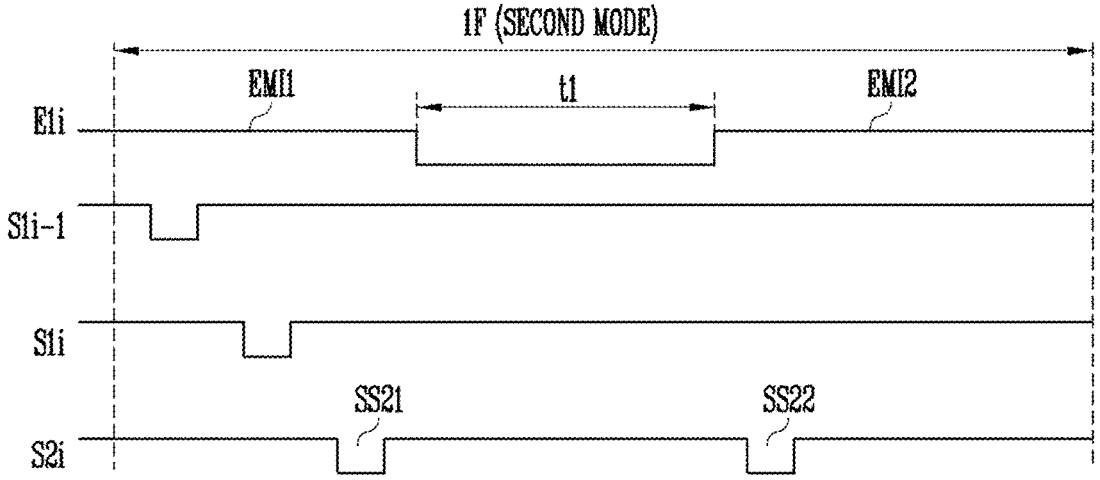
FIG. 12 is a signal timing diagram illustrating an embodiment of a driving method when the first pixel shown in FIG. 9 is driven in a second mode.

FIG. 12 is a signal timing diagram illustrating an embodiment of a driving method when the first pixel shown in FIG. 9 is driven in the second mode. In FIG. 12, portions identical to those of FIG. 10 will be briefly described.

In an embodiment, as described above, the second scan driver 200 supplies k second scan signals (k is a natural number) to each of the second scan lines S21 to S2*n* every predetermined period (e.g., during each frame period) when the organic light emitting display device is driven in the first mode, and the second scan driver 200 supplies j second scan signals (j is a natural number greater than k) to each of the second scan lines S21 to S2*n* every predetermined period when the organic light emitting display device is driven in the second mode. In such an embodiment, as described above, the first emission driver 600 supplies p first light emission control signals (p is a natural number) to each of the first emission control lines E1*i* to En1 every predetermined period (e.g., during each frame period) when the organic light emitting display device is driven in the first mode, and supplies l first light emission control signals (l is a natural number greater than p) to each of the first emission control lines E11 to E1*n* every predetermined period (e.g., during each frame period) when the organic light emitting display device is driven in the second mode. In one embodiment, for example, k is 1, j is 2, p is 1 and l is 2, as shown in FIGS. 10 and 12.

Referring to FIG. 12, in such an embodiment, a first first light emission control signal EMI1 is supplied to the i-th first emission control line E1*i* such that the fifth transistor T5 and the sixth transistor T6 are turned off. When the fifth transistor T5 and the sixth transistor T6 are turned off, the organic light emitting diode OLED is set to be in the non-emission state.

After the first first light emission control signal EMI1 is supplied to the i-th first emission control line E1*i*, the first scan signal is supplied to the (i−1)-th first scan line S1*i*−1 such that the fourth transistor T4 is turned on. When the fourth transistor T4 is turned on, the voltage of the initialization power source is supplied to the first node N1.

After the first scan signal is supplied to the (i−1)-th first scan line S1*i*−1, the first scan signal is supplied to the i-th first scan line S1*i*, and accordingly, the second transistor T2 and the third transistor T3 are turned on.

When the second transistor T2 and the third transistor T3 are turned on, the voltage obtained by subtracting the absolute threshold voltage of the driving transistor MD from the voltage of the data signal is supplied to the first node N1. Accordingly, the storage capacitor Cst stores a voltage corresponding to that of the first node N1.

After the voltage corresponding to the threshold voltage of the driving transistor MD and the data signal is stored in the storage capacitor Cst, a first second scan signal SS21 is supplied to the i-th second scan line S2*i*, and accordingly, the first transistor T1 is turned on.

When the first transistor T1 is turned on, the voltage of the initialization power source Vint is supplied to the anode electrode of the organic light emitting diode OLED. Then, the organic capacitor Coled of the organic light emitting diode OLED is discharged.

After the organic capacitor Coled of the organic light emitting diode OLED is discharged, the supply of the first first light emission control signal EMI1 to the i-th first emission control line E1*i* is stopped. When the supply of the first first light emission control signal EMI1 to the i-th first emission control line E1*i* is stopped, the fifth transistor T5 and the sixth transistor T6 are turned on. When the fifth transistor T5 and the sixth transistor T6 are turned on, the driving transistor MD controls the amount of the current flowing from the first power source ELVDD to the second power source ELVSS via the organic light emitting diode OLED, based on the voltage of the first node N1. Then, the organic light emitting diode OLED generates light with a predetermined luminance corresponding to the amount of the current supplied from the driving transistor MD.

In an embodiment, when the organic light emitting display device is driven in the second mode, an emission period t1 of the first pixel PXL1 is set as a period which is about 40% or less of one frame period 1F.

In an embodiment, when the organic light emitting display device is driven in the second mode, the user is supplied with a predetermined image via the lenses 20. In such an embodiment, when the emission period t1 exceeds about 40% of the one frame period 1F, fatigue of the eyes of the user may be rapidly increased. Accordingly, in an embodiment of the disclosure, the first pixel PXL1 is set to be in an emission state during the period which is about 40% or less of the one frame period 1F.

In an embodiment, the first emission driver 600 supplies a second first light emission control signal EMI2 to the i-th first emission control line E1*i* after the first pixel PXL1 emits light for a predetermined time. In such an embodiment, when the second first light emission control signal EMI2 is supplied, the fifth transistor T5 and the sixth transistor T6 are turned off. When the fifth transistor T5 and the sixth transistor T6 are turned off, the organic light emitting diode OLED is set to be in the non-emission state.

In such an embodiment, a second second scan signal SS22 is supplied to the i-th second scan line S2*i*. When the second second scan signal SS22 is supplied to the i-th second scan line S2*i*, the first transistor T1 is turned on. When the first transistor T1 is turned on, the voltage of the initialization power source Vint is supplied to the organic light emitting diode OLED, and accordingly the luminance of light may be effectively prevented from being increased in black expression.

When the second first light emission control signal EMI2 is supplied to the i-th first emission control line E1*i*, a voltage of the i-th first emission control line E1*i* is increased from a low voltage to a high voltage. Then, a voltage of the anode electrode of the organic light emitting diode OLED is increased by the coupling of a parasitic capacitor (not shown) of the sixth transistor T6. When the voltage of the anode electrode of the organic light emitting diode OLED is increased, the organic light emitting diode OLED may minutely emit light. Accordingly, the organic light emitting diode OLED minutely emits light during a period in which black is expressed after the emission period t1, such that the luminance of the black may be increased.

In an embodiment of the disclosure, when the second second scan signal SS22 is supplied to the i-th second scan line S2*i* after the second first light emission control signal EMI2 is supplied to the i-th first emission control line E1*i*, the voltage of the anode electrode of the organic light emitting diode OLED is decreased to the voltage of the initialization power source Vint. In such an embodiment, the voltage of the initialization power source Vint have a predetermined voltage level such that the organic light emitting diode OLED emits no light when the voltages of the initialization power source is applied thereto, and accordingly, the black may be stably expressed.

In an embodiment, the second second scan signal SS22 may be supplied at various times to overlap with the second first light emission control signal EMI2 in the one frame period 1F. In an embodiment, the second second scan signal SS22 may be supplied in the one frame period 1F after the second first light emission control signal EMI2 is supplied. In an embodiment, the width (e.g., temporal with) of the second second scan signal SS22 may be variously set. In an embodiment, the width of the second second scan signal SS22 may be equal to a width of the first second scan signal SS21.

Figure 13A:
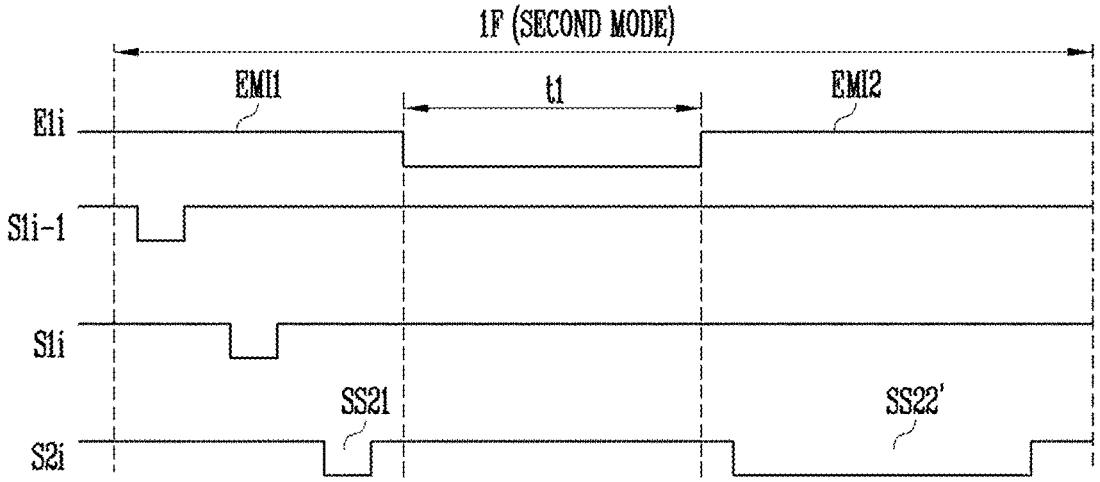
FIGS. 13A and 13B are signal timing diagrams illustrating alternative embodiments of the driving method when the first pixel shown in FIG. 9 is driven in the second mode.
Figure 13B:
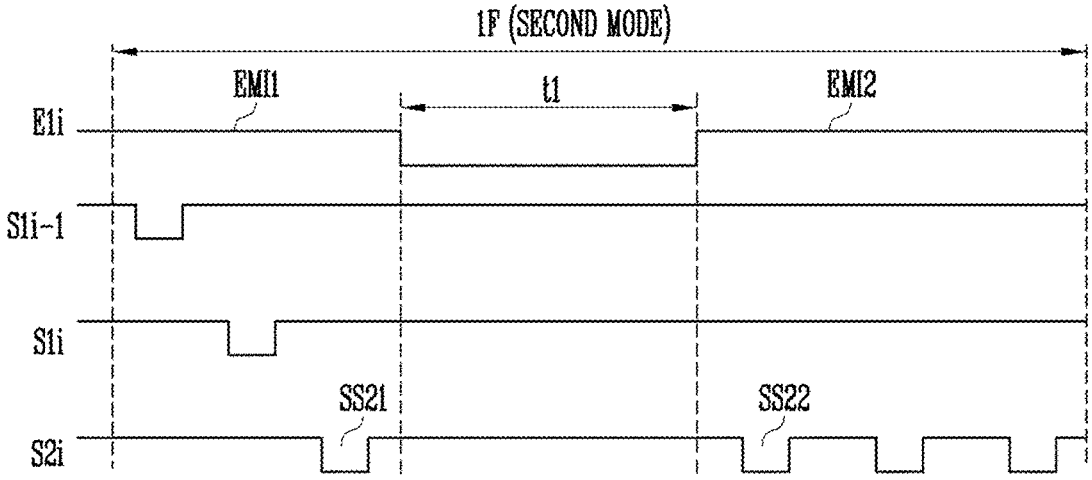

FIGS. 13A and 13B are signal timing diagrams illustrating alternative embodiments of the driving method when the first pixel shown in FIG. 9 is driven in the second mode. In FIGS. 13A and 13B, portions identical to those of FIG. 12 will be briefly described.

Referring to FIG. 13A, in an embodiment of the disclosure, the first emission driver 600 supplies a first first light emission control signal EMI1 to the i-th first emission control line E1*i* and then supplies a second first light emission control signal EMI2 after a predetermined emission period t1 from the first first light emission control signal EMI1.

In an embodiment, the second scan driver 200 supplies a first second scan signal SS21 to the i-th second scan line S2*i* to overlap with the first first light emission control signal, and supplies a second second scan signal SS22' to the i-th second scan line S2*i* to overlap with the second first light emission control signal EMI2. In an embodiment, the second second scan signal SS22' is set to have a width wider than that of the first second scan signal SS21. In such an embodiment, where the second second scan signal SS22' is set to have the width wider than a width of the first second scan signal SS21, the time for supplying the voltage of the initialization power source Vint to the anode electrode of the organic light emitting diode OLED is increased, and accordingly, the black may be stably expressed.

Referring to FIG. 13B, in an embodiment of the disclosure, the first emission driver 600 supplies a first first light emission control signal EMI1 to the i-th first emission control line E1*i* and then supplies a second first light emission control signal EMI2 after a predetermined emission period t1.

In an embodiment, the second scan driver 200 supplies a first second scan signal SS21 to the i-th second scan line S2*i* to overlap with the first first light emission control signal EMI1. In such an embodiment, the second scan driver 200 supplies a plurality of second second scan signals SS22 to the i-th second scan line S2*i* to overlap with the second first light emission control signal EMI2. Then, the anode electrode of the organic light emitting diode OLED is initialized to the voltage of the initialization power source Vint whenever the plurality of second second scan signals SS22 are supplied, and accordingly, the black may be stably expressed.

Figure 14:
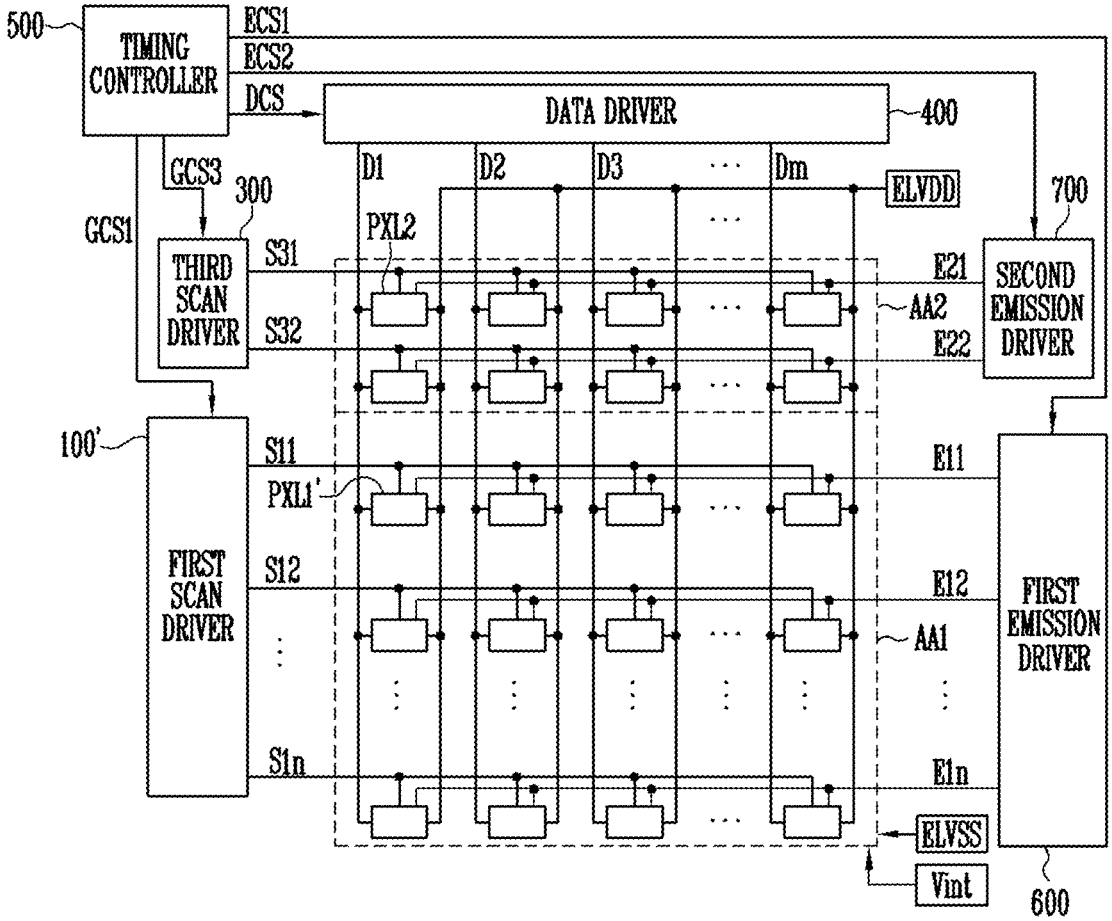
FIG. 14 is a view illustrating an alternative embodiment of the organic light emitting display device corresponding to FIG. 2.

FIG. 14 is a view illustrating an alternative embodiment of the organic light emitting display device corresponding to FIG. 2. In FIG. 14, components identical to those of FIG. 8 are designated by like reference numerals, and their detailed descriptions will be omitted.

Referring to FIG. 14, an embodiment of the organic light emitting display device includes a first scan driver 100', the third scan driver 300, the data driver 400, the timing controller 500, the first emission driver 600 and the second emission driver 700.

First pixels PXL1' are located to be coupled to first scan lines S11 to S1*n*, first emission control lines E11 to E1*n*, and data lines D1 to Dm. The first pixels PXL1' are selected or selectively activated when the first scan signal is supplied to the first scan lines S11 to S1*n* to be supplied with a data signal from the data lines D1 to Dm. An organic light emitting diode included in each of the first pixels PXL1' is initialized to a voltage of an initialization power source Vint when the first scan signal is supplied to the first scan lines S11 to S1*n*.

The first pixels PXL1' supplied with the data signal generate light with a predetermined luminance corresponding to the data signal. Here, the emission time of the first pixel PXL1' is controlled by a first light emission control signal supplied from the first emission control lines E11 to E1*n*.

The first scan driver 100' supplies the first scan signal to the first scan lines S11 to S1*n*, corresponding to a first gate control signal GCS1. In an embodiment, the first scan driver 100' may sequentially supply the first scan signal to the first scan lines S11 to S1*n*. When the first scan signal is sequentially supplied to the first scan lines S11 to S1*n*, the first pixels PXL1' are sequentially selected or turned on in units of horizontal lines. In such an embodiment, the first scan signal is set to have the gate-on voltage such that transistors included in the first pixels PXL1' are sequentially turned on.

In an embodiment, when the organic light emitting display device is driven in the first mode and the second mode, the first scan driver 100' supplies the first scan signal to the first scan lines S11 to S1*n*. Thus, the first pixels PXL1' may display a predetermined image regardless of the mode (i.e., the first mode or the second mode) of the organic light emitting display device.

Figure 15:
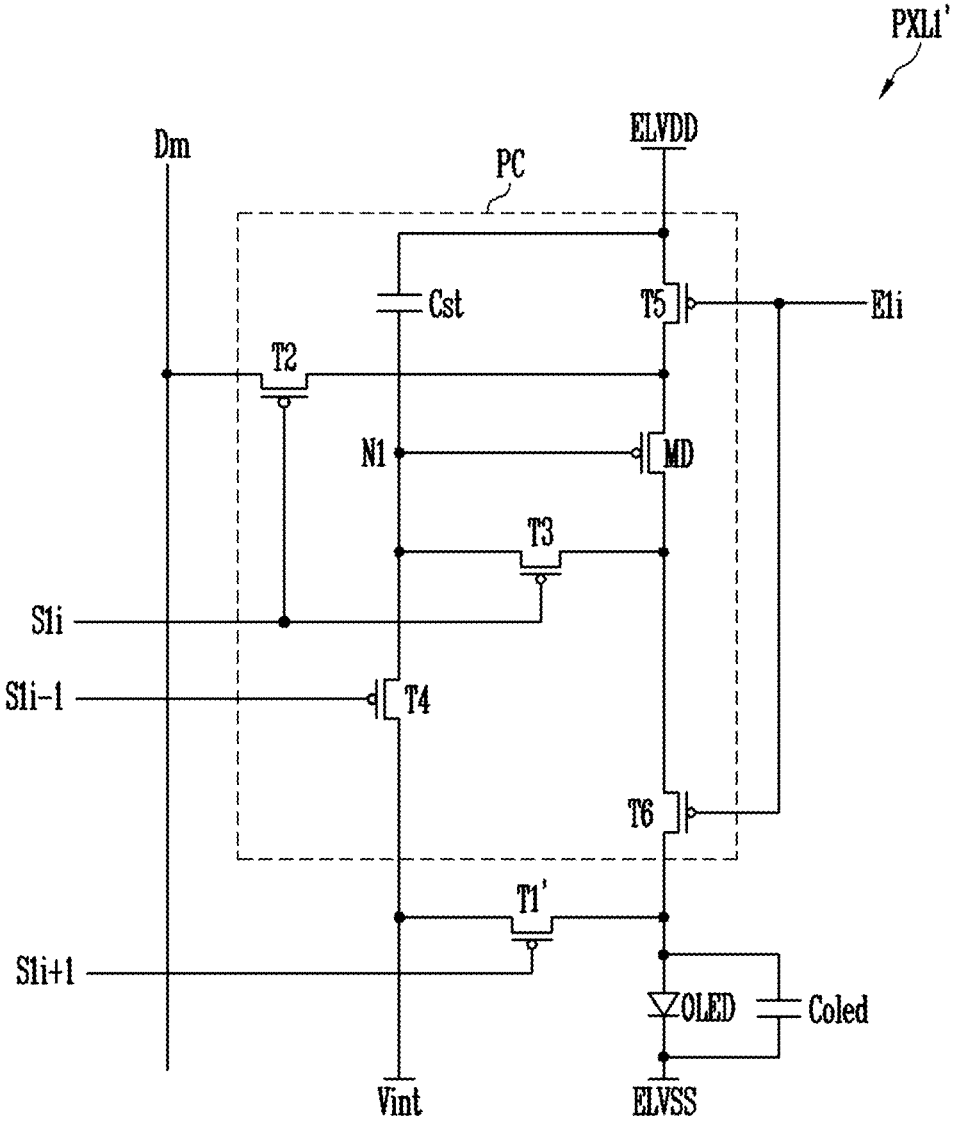
FIG. 15 is a view illustrating an embodiment of a first pixel shown in FIG. 14.

FIG. 15 is a view illustrating an embodiment of the first pixel shown in FIG. 14. The same or like elements shown in FIG. 15 have been labeled with the same reference characters as used above to describe the embodiments of the first pixel shown in FIG. 9, and any repetitive detailed description thereof will hereinafter be omitted or simplified.

Referring to FIG. 15, in an embodiment, the first pixel PXL1' includes the organic light emitting diode OLED, the pixel circuit PC for controlling the amount of the current supplied to the organic light emitting diode OLED, and a first transistor T1'.

The first transistor T1' is coupled between the initialization power source Vint and the anode electrode of the organic light emitting diode OLED. In such an embodiment, a gate electrode of the first transistor T1' is coupled to an (i+1)-th first scan line S1*i*+1. The first transistor T1' is turned on when the first scan signal is supplied to the (i+1)-th first scan line S1*i*+1 to supply the voltage of the initialization power source Vint to the anode electrode of the organic light emitting diode OLED.

When the first pixel PXL1' shown in FIG. 15 is driven in the first mode, a driving method thereof is substantially the same as that described above with reference to FIG. 10, and any repetitive detailed description thereof will be omitted.

Figure 16:
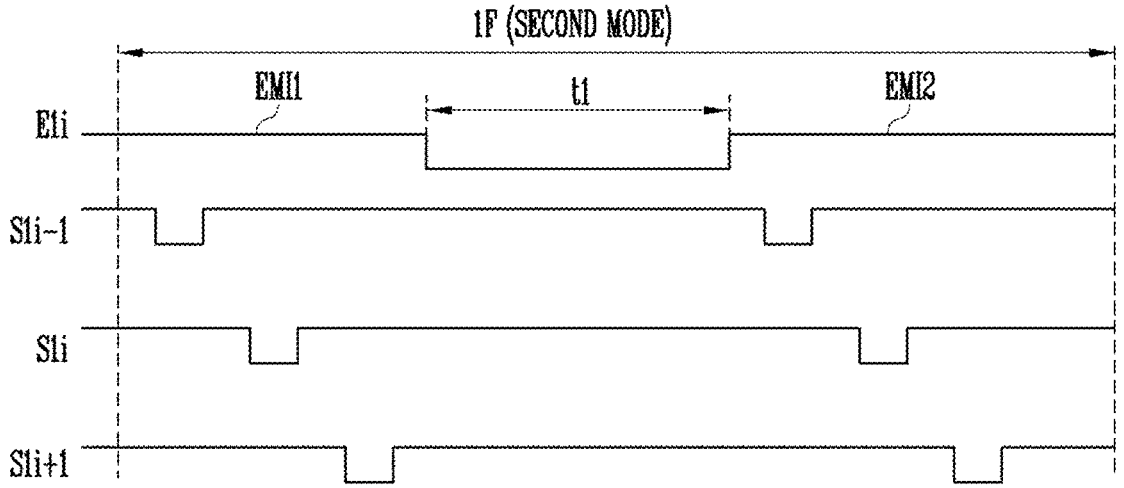
FIG. 16 is a signal timing diagram illustrating an embodiment of a driving method when the first pixel shown in FIG. 15 is driven in the second mode.

FIG. 16 is a signal timing diagram illustrating an embodiment of a driving method when the first pixel shown in FIG. 15 is driven in the second mode.

Referring to FIG. 16, in an embodiment, a first first light emission control signal EMI1 is supplied to the i-th first emission control line E1*i* such that the fifth transistor T5 and the sixth transistor T6 are turned off. When the fifth transistor T5 and the sixth transistor T6 are turned off, the organic light emitting diode OLED is set to be in the non-emission state.

After the first first light emission control signal EMI1 is supplied to the i-th first emission control line E1*i*, the first scan signal is supplied to the (i−1)-th first scan line S1*i*−1 such that the fourth transistor T4 is turned on. When the fourth transistor T4 is turned on, the voltage of the initialization power source Vint is supplied to the first node N1.

After the first scan signal is supplied to the (i−1)-th first scan line S1*i*−1, the first scan signal is supplied to the i-th first scan line S1*i*, and accordingly, the second transistor T2 and the third transistor T3 are turned on.

When the second transistor T2 and the third transistor T3 are turned on, the voltage obtained by subtracting the absolute threshold voltage of the driving transistor MD from the voltage of the data signal is supplied to the first node N1. Accordingly, the storage capacitor Cst stores a voltage corresponding to that of the first node N1.

After the voltage corresponding to the threshold voltage of the driving transistor MD and the data signal is stored in the storage capacitor Cst, the first scan signal is supplied to the (i+1)-th first scan line S1*i*+1, and accordingly, the first transistor T1' is turned on.

When the first transistor T1' is turned on, the voltage of the initialization power source Vint is supplied to the anode electrode of the organic light emitting diode OLED. Then, the organic capacitor Coled of the organic light emitting diode OLED is discharged.

After the organic capacitor Coled of the organic light emitting diode OLED is discharged, the supply of the first first light emission control signal EMI1 to the i-th first emission control line E1*i* is stopped. When the supply of the first first light emission control signal EMI1 to the i-th first emission control line E1*i* is stopped, the fifth transistor T5 and the sixth transistor T6 are turned on. Accordingly, the driving transistor MD controls the amount of the current flowing from the first power source ELVDD to the second power source ELVSS via the organic light emitting diode OLED, based on the voltage of the first node N1. Then, the organic light emitting diode OLED generates light with a predetermined luminance corresponding to the amount of the current supplied from the driving transistor MD. After that, the first pixel PXL1' is driven corresponding to the data signal during an emission period t1 set as a period, which is about 40% or less of one frame period 1F.

After the emission period t1, the first emission driver 600 supplies a second first light emission control signal EMI2 to the i-th first emission control line E1*i*. When the second first light emission control signal EMI2 is supplied to the i-th first emission control line E1*i*, the fifth transistor T5 and the sixth transistor T6 are turned off. When the fifth transistor T5 and the sixth transistor T6 are turned off, the organic light emitting diode OLED is set to be in the non-emission state.

After that, the first scan signal is sequentially supplied to the (i−1)-th first scan line S1*i*−1, the i-th first scan line S1*i*, and the (i+1)-th first scan line S1*i*+1. Here, although the first scan signal is supplied to the (i−1)-th first scan line S1*i*−1 and the i-th first scan line S1*i*, the non-emission state of the first pixel PXL1' is maintained by the second first light emission control signal EMI2.

When the first scan signal is supplied to the (i+1)-th first scan line S1*i*+1, the first transistor T1' is turned on. When the first transistor T1' is turned on, the voltage of the initialization power source Vint is supplied to the organic light emitting diode OLED, and accordingly, the luminance of light may be effectively prevented from being increased in black expression.

Figure 17:
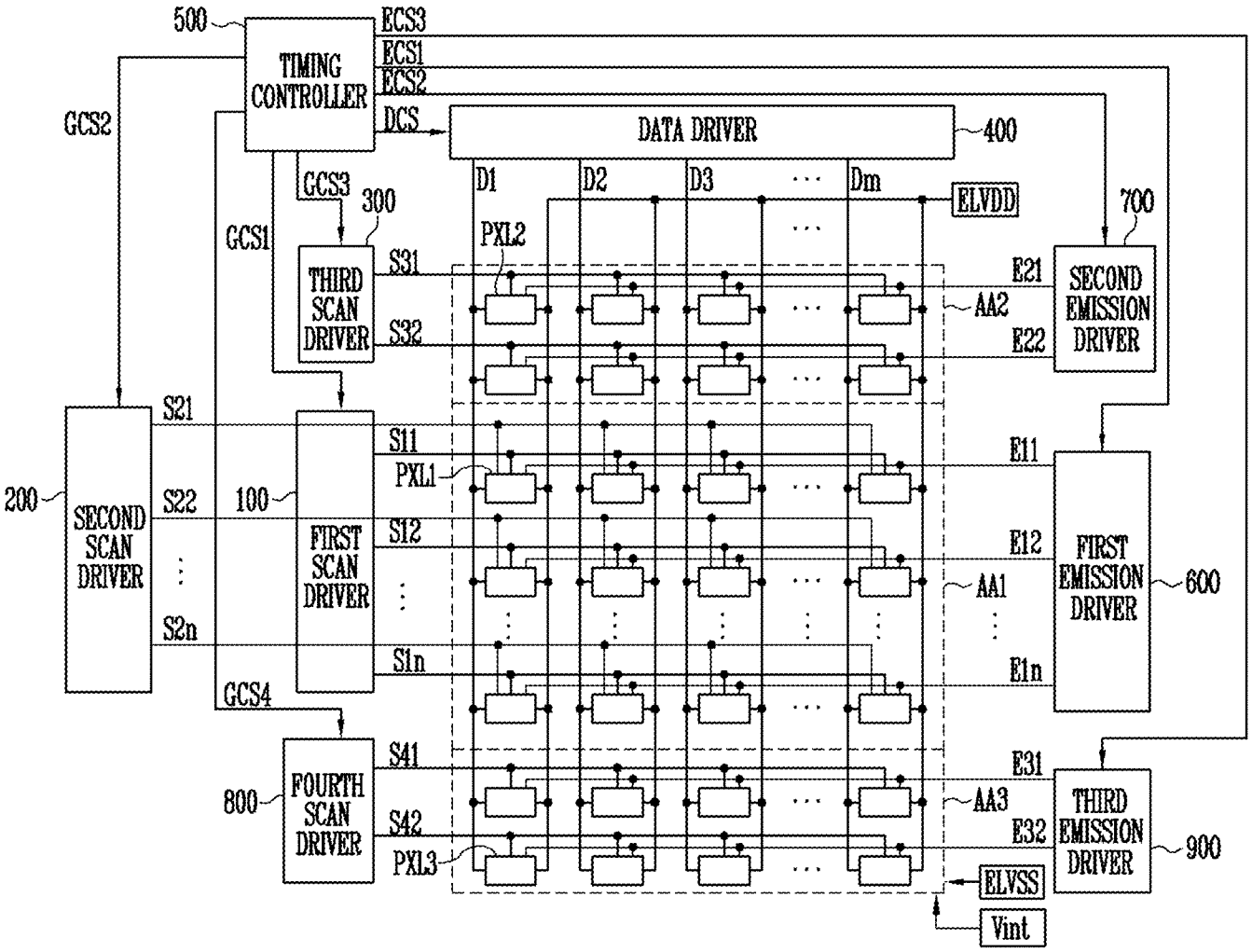
FIG. 17 is a view illustrating an embodiment of the organic light emitting display device corresponding to FIG. 5.

FIG. 17 is a view illustrating an embodiment of the organic light emitting display device corresponding to FIG. 5. In FIG. 17, components identical to those of FIG. 8 are designated by like reference numerals, and any repetitive detailed description thereof will be omitted.

Referring to FIG. 17, an embodiment of the organic light emitting display device includes the first scan driver 100, the second scan driver 200, the third scan driver, a fourth scan driver 800, the data driver 400, the timing control driver (or timing controller) 500, the first emission driver 600, the second emission driver 700, and a third emission driver 900.

A pixel region is divided into a first pixel region AA1, a second pixel region AA2, and a third pixel region AA3. In an embodiment, the first pixel region AA1 includes first pixels PXL1, and the second pixel region AA2 includes second pixels PXL2. In such an embodiment, the third pixel region AA3 includes third pixels PXL3.

The third pixels PXL3 are connected to fourth scan lines S41 and S42, third emission control lines E31 and E32, and the data lines D1 to Dm. The third pixels PXL3 are selected or selectively activated when a fourth scan signal is supplied to the fourth scan lines S41 and S42 to be supplied with a data signal from the data lines D1 to Dm. The fourth pixels PXL4 supplied with the data signal generate light with a predetermined luminance corresponding to the data signal. Here, the emission time of the fourth pixels PXL4 is controlled by a third light emission control signal supplied from the third emission control lines E31 and E32.

In an embodiment, as shown in FIG. 17, two fourth scan lines S41 and S42 and two third emission control lines E31 and E32 are formed in the third pixel region AA3, but the disclosure is not limited thereto. In an alternative embodiment, two or more fourth scan lines S41 and S42 and two or more third emission control lines E31 and E32 may be formed in the third pixel region AA3. In an embodiment, one or more dummy scan lines (not shown) and one or more dummy emission control lines (not shown) may be additionally formed in the third pixel region AA3, corresponding to a circuit structure of the third pixel PXL3. In such an embodiment, the circuit structure of the third pixel PXL3 is set substantially identical to that of the first pixel PXL1, and therefore, any repetitive detailed description thereof will be omitted.

The fourth scan driver 800 supplies the fourth scan signal to the fourth scan lines S41 and S42, corresponding to a fourth gate control signal GCS4. In an embodiment, the fourth scan driver 800 may sequentially supply the fourth scan signal to the fourth scan lines S41 and S42. When the fourth scan signal is sequentially supplied to the fourth scan lines S41 and S42, the third pixels PXL3 are sequentially selected in units of horizontal lines. In such an embodiment, the fourth scan signal is set to have the gate-on voltage based on the fourth gate control signal GCS4 such that transistors included in the third pixels PXL3 are turned on.

In an embodiment, the fourth scan driver 800 supplies the fourth scan signal to the fourth scan lines S41 and S42 when the organic light emitting display device is driven in the first mode, and does not supply the fourth scan signal to the fourth scan lines S41 and S42 when the organic light emitting display device is driven in the second mode. Therefore, when the organic light emitting display device is driven in the second mode, the fourth scan lines S41 and S42 are set to have the gate-off voltage.

The third emission driver 900 is supplied with a third emission control signal ECS3 from the timing controller 500. The third emission driver 900 supplied with the third emission control signal ECS3 supplies the third light emission control signal to the third emission control lines E31 and E32. In an embodiment, the third emission driver 900 may sequentially supply the third light emission control signal to the third emission control lines E31 and E32. The third light emission control signal is supped to control the emission time of the third pixel PXL3. In an embodiment, the third light emission control signal is set to have the gate-off voltage such that the transistors included in the third pixels PXL3 are turned off.

In an embodiment, when the organic light emitting display device is driven in the first mode, the third emission driver 900 sequentially supplies the third light emission control signal to the third emission control lines E31 and E32. In such an embodiment, when the organic light emitting display device is driven in the second mode, the third emission driver 900 supplies the third light emission control signal to the third emission control lines E31 and E32 during one frame period. Thus, when the organic light emitting display device is driven in the second mode, the third emission control lines E31 and E32 are set to have the gate-off voltage, and accordingly, the third pixels PXL3 are set to be in the non-emission state.

In embodiments of the organic light emitting display device and the driving method thereof according to the disclosure, a plurality of light emission control signals are supplied when the organic light emitting display device is mounted in a wearable device. In such an embodiment, the voltage of the initialization power source is supplied to the anode electrode of the organic light emitting diode whenever the plurality of light emission control signals are supplied, and accordingly, black may be stably expressed.

Some exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the disclosure as set forth in the following claims.

What is claimed is:

1. An organic light emitting display device comprising:

a first pixel region including first pixels, which are coupled to first scan lines, second scan lines and emission control lines;

a first scan driver which supplies a first scan signal to each of the first scan lines coupled to the first pixels;

a second scan driver which supplies a second scan signal to each of the second scan lines coupled to the first pixels; and an emission driver which supplies a light emission control signal to the emission control lines coupled to the first pixels, wherein the organic light emitting display device is driven in a second mode when the organic light emitting display device is mounted in a wearable device, and is driven in a first mode otherwise, wherein the first pixels are driven based on a data signal when the organic light emitting display device is driven in the first mode and the second mode, wherein the second scan driver supplies k second scan signals to each of the second scan lines during each frame period when the organic light emitting display device is driven in the first mode, and supplies j second scan signals to each of the second scan lines during each frame period when the organic light emitting display device is driven in the second mode, and wherein k is a natural number, and j is a natural number greater than k.

2. The organic light emitting display device of claim 1, further comprising:

a second pixel region including second pixels driven based on the data signal when the organic light emitting display device is driven in the first mode, wherein the second pixel region is set to be in a non-emission state when the organic light emitting display device is driven in the second mode.

3. The organic light emitting display device of claim 2, further comprising:

a third pixel region including third pixels driven corresponding to the data signal when the organic light emitting display device is driven in the first mode, wherein the third pixel region being set to be in the non-emission state when the organic light emitting display device is driven in the second mode.

4. The organic light emitting display device of claim 3, wherein the first pixel region is located between the second pixel region and the third pixel region.

5. The organic light emitting display device of claim 1, wherein the emission driver supplies p light emission control signals to each of the emission control lines when the organic light emitting display device is driven in the first mode, wherein p is a natural number, and the emission driver supplies 1 light emission control signals to each of the emission control lines when the organic light emitting display device is driven in the second mode, wherein 1 is a natural number greater than p.

6. The organic light emitting display device of claim 1, wherein each of the pixels located on an i-th pixel row comprises:

an organic light emitting diode;

a pixel circuit which stores a voltage of the data signal applied thereto when the first scan signal is supplied to an i-th first scan line of the first scan lines, and controls a supply time of a current to the organic light emitting diode, based on a light emission control signal supplied to an i-th emission control line of the emission control lines; and a first transistor coupled between an initialization power source and an anode electrode of the organic light emitting diode, wherein the first transistor is turned on when the second scan signal is supplied to an i-th second scan line of the second scan lines, and wherein i is a natural number.

7. The organic light emitting display device of claim 6, wherein a voltage of the initialization power source has a predetermined voltage level such that the organic light emitting diode emits no light when the voltage of the initialization power source is applied thereto.

8. The organic light emitting display device of claim 6, wherein, when the organic light emitting display device is driven in the first mode, the emission driver supplies a light emission control signal to the i-th emission control line during a partial period in one frame period, the first scan driver supplies the first scan signal to an (i−1)-th first scan line of the first scan lines and the i-th first scan line to overlap with the light emission control signal, and the second scan driver supplies the second scan signal to the i-th second scan line to overlap with the light emission control signal.

9. The organic light emitting display device of claim 8, wherein the light emission control signal is set to be an gate-off voltage, and the first scan signal and the second scan signal are set to be a gate-on voltage.

10. The organic light emitting display device of claim 8, wherein the i-th second scan line is defined by any one of the first scan lines supplied with the first scan signal to overlap with the light emission control signal supplied to the i-th emission control line.

11. The organic light emitting display device of claim 10, wherein the first scan driver and the second scan driver is disposed in a same scan driver.

12. The organic light emitting display device of claim 6, wherein, when the organic light emitting display device is driven in the second mode, the emission driver supplies a first light emission control signal to the i-th emission control line, and the emission driver supplies a second light emission control signal to the i-th emission control line after a predetermined period from the first light emission control signal in one frame period.

13. The organic light emitting display device of claim 12, wherein the predetermined period is set as a period, which is about 40% or less of the one frame period.

14. The organic light emitting display device of claim 12, wherein the first scan driver supplies the first scan signal to the (i−1)-th first scan line and the i-th first scan line to overlap with the first light emission control signal, and the second scan driver supplies a first second scan signal to the i-th second scan line to overlap with the first light emission control signal, and supplies a second second scan signal to the i-th second scan line to overlap with the second light emission control signal.

15. The organic light emitting display device of claim 14, wherein the first second scan signal and the second second scan signal have a same width as each other.

16. The organic light emitting display device of claim 14, wherein the second second scan signal has a width wider than a width of the first second scan signal.

17. The organic light emitting display device of claim 6, wherein the pixel circuit comprises:

a driving transistor which controls an amount of a current supplied from a first power source coupled to a first electrode thereof to the organic light emitting diode coupled to a second electrode thereof, based on a voltage of a first node;

a second transistor coupled between a data line and the first electrode of the driving transistor, wherein the second transistor includes a gate electrode coupled to the i-th first scan line;

a third transistor coupled between the second electrode of the driving transistor and the first node, wherein the third transistor includes a gate electrode coupled to the i-th first scan line;

a fourth transistor coupled between the first node and the initialization power source, wherein the fourth transistor includes a gate electrode coupled to the (i−1)-th first scan line;

a fifth transistor coupled between the first power source and the first electrode of the driving transistor, wherein the fifth transistor includes a gate electrode coupled to the i-th emission control line;

a sixth transistor coupled between the second electrode of the driving transistor and the anode electrode of the organic light emitting diode, wherein the sixth transistor includes a gate electrode coupled to the i-th emission control line; and a storage capacitor coupled between the first power source and the first node.

* * * * *